US011603760B2

(12) United States Patent
Kawasaki et al.

(10) Patent No.: US 11,603,760 B2
(45) Date of Patent: Mar. 14, 2023

(54) SHIELD METHOD

(71) Applicant: Mutsubishi Rubber Co., Ltd., Kobe (JP)

(72) Inventors: Naoki Kawasaki, Kobe (JP); Koichi Kaburaki, Tokyo (JP); Masaki Hara, Kobe (JP)

(73) Assignee: Mutsubishi Rubber Co., Ltd., Kobe (JP)

( * ) Notice: Subject to any disclaimer, the term of this patent is extended or adjusted under 35 U.S.C. 154(b) by 0 days.

(21) Appl. No.: 17/469,894

(22) Filed: Sep. 9, 2021

(65) Prior Publication Data

US 2022/0220850 A1 Jul. 14, 2022

(30) Foreign Application Priority Data

Jan. 14, 2021 (JP) ..... JP2021-004408

(51) Int. Cl.
*E21D 9/00* (2006.01)
*E21D 9/087* (2006.01)

(52) U.S. Cl.
CPC ..... *E21D 9/0873* (2016.01)

(58) Field of Classification Search
CPC ..... E21D 9/0873; E21D 9/008
See application file for complete search history.

(56) References Cited

U.S. PATENT DOCUMENTS 4,052,859 A * 10/1977 Iwamitsu ..... E21D 9/08 405/144
9,890,637 B2 * 2/2018 Cucino ..... E21D 9/008

FOREIGN PATENT DOCUMENTS

| | | | |
|---|---|---|---|
| JP | H10-102980 | A | 4/1998 |
| JP | H11-229755 | A | 8/1999 |
| JP | H11-303569 | A | 11/1999 |
| JP | 2001-152780 | A | 6/2001 |
| JP | 4486250 | B2 | 6/2010 |
| JP | 2016-003551 | A | 1/2016 |
| JP | 2019-007131 | A | 1/2019 |

* cited by examiner

*Primary Examiner* — Janine M Kreck
(74) *Attorney, Agent, or Firm* — Metrolex IP Law Group, PLLC

(57) ABSTRACT

A shield method includes the steps: providing a first cylindrical frame 31 at a position where an entrance 12 is to be formed in an inner surface of an earth retaining wall 11 of a shaft 1; excavating a horizontal hole 5 in the underground by a shield machine 2, and sequentially adding and building, in the excavation direction, a plurality of segments 4 on an inner diameter side of the horizontal hole 5 while forming the entrance 12 in the shaft 1; temporarily stopping water from a gap between the entrance 12 and the shield machine 2, and removing excavated soil and pieces 6 that enter the first cylindrical frame 31 as the entrance 12 is formed; and coupling a second cylindrical frame 32 having a sealing member 35 attached thereto to an inner open end of the first cylindrical frame 31.

4 Claims, 17 Drawing Sheets

SHIELD METHOD

TITLE OF THE INVENTION

BACKGROUND OF THE INVENTION

The present invention relates to a shield method in which a tunnel is made using a shield machine between two shafts constructed in the ground.

When making a tunnel using a shield machine between two shafts constructed in the ground, for example, an entrance apparatus is disposed, in advance, at a position where the entrance is to be formed in the inner circumferential surface of an earth retaining wall of the arrival shaft.

The entrance apparatus includes an entrance frame, a sealing member and the like. The entrance frame is formed to have a cylindrical shape into which the shield machine can go without coming into contact with any part thereof, and attached to the position where the entrance is to be formed in the inner circumferential surface of the earth retaining wall of the arrival shaft.

The sealing member is disposed at a predetermined position on the inner circumferential surface of the entrance frame. The sealing member comes into contact with the outer circumferential surface of the shield machine when the shield machine excavates the earth retaining wall of the shaft and enters the entrance frame. When the shield machine further moves forward and goes beyond the sealing member so that segments as an outer shell of the tunnel are disposed, the sealing member comes into contact with an outer circumferential surface of the segments.

Generally, when the shield machine excavates the ground and the earth retaining wall of the arrival shaft to advance, the excavated soil and pieces enter the entrance frame. Then, when the excavated soil and pieces get stuck between the outer circumferential surface of the shield machine or the segment and the sealing member, the sealing member may not function in a normal manner.

Here, the term "soil" (or also referred to as "ground") means a mixture of minerals, organic matter, gases, liquids and living organisms, which cover the land surface of the earth.

For example, in Patent Document 1, it is recited: "When a tunnel is excavated using the shield method, the tunnel body is connected to a tunnel arrival port formed in the earth retaining wall body of the arrival shaft using a tunnel excavator (corresponding to the shield machine). An annular body is fixed in advance, by an anchor bolt or the like, to a position where the tunnel arrival port is to be formed. The annular body has a sufficiently large diameter to surround the above position. An opening-side flange of the annular body is superimposed on a flange of a cylinder body via packing in the axis direction such that they are connected to each other by bolts and nuts. Then, when a shield cylinder of the tunnel excavator enters the inside of the cylinder body as a result of excavation of soil and the earth retaining wall body of the shaft by the tunnel excavator, an annular seal member provided on the inner circumferential surface of the cylinder body comes into contact with an outer circumferential surface of the shield cylinder".

Also in Patent Document 1, it is recited: "A front part of the tunnel excavator 3 penetrates the earth retaining wall body 1 and enters the annular body 2. At this time, if the water pressure in the soil E is high, spring water enters the inside of the cylinder body 5. Thus, a detection nozzle 6*a* is opened to detect water pressure, water quality, amount of water and the like, and if necessary, water stop work is carried out in the vicinity of the tunnel arrival port".

For example, in Patent Document 2, it is recited: "The inside of an entrance chamber 4 is filled with a filler 5 containing sand in advance. Then, a shield excavator 12 (corresponding to the shield machine) is advanced to excavate ground 11 and a shaft wall 8 while a cleaning liquid c composed of water is jetted into the filler 5 containing sand so that muddy water generated by mixing the sand with the water permeates an inner space between the entrance chamber 4 and the shield excavator 12. Thus, the pressure of slurry having high specific gravity and viscosity overcomes the outflow pressure of the ground 11 and stops the water. Surplus muddy water d is collected in a mud discharge ditch 2*c* at the lower part so as to be released from a mud discharge port 3*b* into a shaft 7 by opening a shut-off valve 16 set in the lower part of a lid part 3".

For example, in Patent Document 3, it is recited: "An entrance chamber having a larger diameter than an outer diameter of the shield excavator (corresponding to the shield machine) is attached to an inner wall surface of the arrival shaft. When the shield excavator penetrates the inner wall of the shaft, the inside and the outside of the shaft are liquid-tightly separated by the entrance chamber. After that, the shield excavator moves forward in a state in which the inside of the entrance chamber is pressurized by a pressurizing means, and reaches the inside of the entrance chamber. Then, the space between an inner circumferential surface of the entrance chamber and an outer circumferential surface of the shield excavator is sealed, and thereafter, the inner pressure of the entrance chamber is reduced, and the entrance chamber further inside the shaft than the sealed part is disassembled".

[Patent Document 1] JP H10-102980 A
[Patent Document 2] JP 4486250
[Patent Document 3] JP H11-229755 A

SUMMARY OF THE INVENTION

In Patent Document 1, the annular body and the cylinder body are provided at a position where the tunnel arrival port is to be formed, and the tunnel excavator is started to excavate soil and the earth retaining wall body of the arrival shaft. However, Patent Document 1 is silent about the excavated soil and pieces.

In Patent Document 2, it is recited that "since the muddy water containing sand and high-pressure water permeates the entrance chamber 4 by jetting the cleaning liquid c composed of high-pressure water into the filler 5 containing sand with which the entrance chamber 4 is filled, it is possible to overcome the outflow pressure of the ground 11 and to stop the water". However, it should be noted that construction expenses may rise due to increase of equipment costs because "the equipment to supply the cleaning liquid c composed of high-pressure water (e.g. a pressurizing device 17 and a piping system 14) is required".

In Patent Document 3, it is recited that "by setting the internal pressure P2 in the entrance chamber 13 to be substantially equal to or higher than the underground water pressure P1, it is possible to prevent earth and sand from flowing into the entrance chamber 13 from the surrounding natural ground when the shield excavator 1 enters the entrance chamber 13". However, it should be noted that construction expenses may rise due to increase of equipment costs because "a pressurizing device 14 is required, and also the pressurizing device 14 is needed to be installed on the wall part of the shaft 2".

In consideration of the above circumstances, the present invention was made to provide a shield method in which a tunnel is made using a shield machine between two shafts constructed in the ground, an object of which is to prevent excavated soil and pieces from getting stuck in the sealing member while reducing construction expenses and ensuring work safety.

The shield method of the present invention is a shield method in which a tunnel is made using a shield machine between two shafts constructed in the ground. The method includes the following steps performed in this order: a first step of providing a first cylindrical frame at a position where an entrance is to be formed in an inner surface of an earth retaining wall of a shaft on an arrival side of the shield machine, the first cylindrical frame into which the shield machine goes without coming into contact with any part thereof; a second step of excavating a horizontal hole in the underground by the shield machine, sequentially adding and building, in an excavation direction, a plurality of segments that serves as an outer shell of the tunnel on an inner diameter side of the horizontal hole, and stopping, after forming the entrance in the arrival shaft, the shield machine such that the shield machine stays in the entrance; a third step of temporarily stopping water from a gap between an inner circumference of the entrance and an outer circumferential surface of the shield machine, and after that removing excavated soil and pieces that enter the first cylindrical frame as a result of forming the entrance; and a fourth step of coupling a second cylindrical frame to an inner open end of the first cylindrical frame, the second cylindrical frame having at least the same inner diameter as that of the first cylindrical frame, and furthermore having a sealing member that is attached to an inner diameter side of the second cylindrical frame.

With this configuration, it is possible to use the entrance apparatus having a relatively simple structure including the first cylindrical frame and the second cylindrical frame so as to form the entrance quickly and safely in the earth retaining wall of the arrival shaft. It is also possible to prevent the excavated soil and pieces from getting stuck in the sealing member of the second cylindrical frame.

Thus, it is possible to ensure a desired water-stopping effect by the sealing member while reducing construction expenses and ensuring work safety.

The above-described shield method may further include the following steps: a fifth step of pressing the sealing member against the outer circumferential surface of the shield machine when the shield machine goes beyond the sealing member after performing the fourth step; and a sixth step of further tightly pressing the sealing member against an outer circumferential surface of the segments when the shield machine moves further forward and reaches a location where the outer circumferential surface of the segments comes into contact with the sealing member.

With this configuration, by removing, in the third step, the excavated soil and pieces that enter the first cylindrical frame as a result of forming the entrance in the earth retaining wall of the arrival shaft in the second step, it is possible to reliably prevent the excavated soil and pieces from getting stuck in a part of the sealing member that is pressed against the outer circumferential surface of the shield machine in the fifth step.

The above-described shield method may further include the following steps: a first auxiliary step of providing a temporary lid on the inner open end of the first cylindrical frame such that the inner open end is closed, and filling a space surrounded by the temporary lid, the first cylindrical frame and the earth retaining wall with a filler, the first auxiliary step being performed before advancing to the second step after performing the first step; and a second auxiliary step of removing the temporary lid, the second auxiliary step being performed before advancing to the third step after performing the second step.

With this configuration, the inner space (entrance space) of the first cylindrical frame is sealed by the temporary lid and thus the entrance space is filled with the filler. Therefore, the internal pressure of the entrance space can be made equal to or higher than the underground pressure.

In this way, it is possible to reduce/prevent large cracking of the earth retaining wall when the entrance is formed in the earth retaining wall of the arrival shaft in the second step.

The above-described shield method may further include the following steps: a first auxiliary step of providing a temporary lid on the inner open end of the first cylindrical frame such that the inner open end is closed, and filling a space surrounded by the temporary lid, the first cylindrical frame and the earth retaining wall with a filler, the first auxiliary step being performed before advancing to the second step after performing the first step; a second auxiliary step of removing the temporary lid, the second auxiliary step being performed before advancing to the third step after performing the second step; a third auxiliary step of providing a temporary lid on an inner open end of the second cylindrical frame such that the inner open end is closed, the third auxiliary step being performed before advancing to the fifth step after performing the fourth step; and a fourth auxiliary step of removing the temporary lid that is provided in the third auxiliary step, the fourth auxiliary step being performed after performing the fifth step.

With this configuration, the inner space (entrance space) of the first cylindrical frame is sealed by the temporary lid and thus the entrance space is filled with the filler. Therefore, the internal pressure of the entrance space can be made equal to or higher than the underground pressure.

In this way, it is possible to reduce/prevent large cracking of the earth retaining wall when the entrance is formed in the earth retaining wall of the arrival shaft in the second step.

Apart from the above, with this configuration, even if spring water, groundwater or muddy water enters the entrance space from the ground after performing the fifth step, it is possible to prevent the spring water, the groundwater or the muddy water from leaking out into the shaft.

Also in the above-described shield method, the sealing member may include: a tapered-shaped elastic sheet that is fixed to an inner circumferential surface of the second cylindrical frame, the elastic sheet having an inner diameter smaller than an outer diameter of the shield machine and an outer diameter of the segments; and a pressurizing member that bends the elastic sheet to reduce the diameter of the elastic sheet so that an inner circumferential part of the elastic sheet is pressed against the outer circumferential surface of the shield machine and an outer circumferential surface of the segments.

Here, the configuration of the sealing member is specified such that the sealing member can exert a sufficient sealing function with a relatively simple structure.

With this configuration, even if spring water, groundwater or muddy water enters the entrance space from the ground after performing the fifth step, it is possible to prevent the spring water, the groundwater or the muddy water from leaking out into the shaft.

Also in the above-described shield method, the pressurizing member may include: an elastic tube that expands as an inside thereof is filled with fluid; and a filling device that reduces the diameter of the elastic sheet by filling the elastic tube with the fluid.

Here, the configuration of the pressurizing member is specified. With this configuration, it is possible to reliably pressurize the elastic sheet.

Also in the above-described shield method, the sealing member may include: an annular-shaped elastic sheet fixed to an inner open end of the second cylindrical frame so as to extend inside in a radial direction, the elastic sheet having an inner diameter smaller than an outer diameter of the shield machine and an outer diameter of the segments; and a wire mounted on a farther and outer side of the elastic sheet relative to the entrance, the wire being loosened to allow the diameter of the elastic sheet to be expanded so that the elastic sheet is bent when the shield machine enters the inner diameter side, while being tightened to allow the diameter of the elastic sheet to be reduced so that an inner circumferential part of the elastic sheet is pressed against the outer circumferential surface of the shield machine.

Here, the configuration of the sealing member is specified such that the sealing member can exert a sufficient sealing function with a relatively simple structure.

With this configuration, even if spring water, groundwater or muddy water enters the entrance space from the ground after performing the fifth step, it is possible to prevent the spring water, the groundwater or the muddy water from leaking out into the shaft.

The present invention provides an excavation method capable of preventing excavated soil and pieces from getting stuck in a sealing member while reducing construction expenses and ensuring work safety.

DETAILED DESCRIPTION OF EMBODIMENTS

Hereinafter, preferred embodiments of the present invention will be described in detail with reference to the appended drawings.

FIGS. 1 to 7 show an embodiment of the present invention. A shield method of the present invention is a method in which a tunnel is made using a shield machine between two shafts constructed in the ground. Specifically, the present invention is related to processes to form an entrance in an earth retaining wall of an arrival shaft.

Before describing the shield method, a description is given on a shield machine 2 and an entrance apparatus 3 both used in the shield method.

Figure 2:
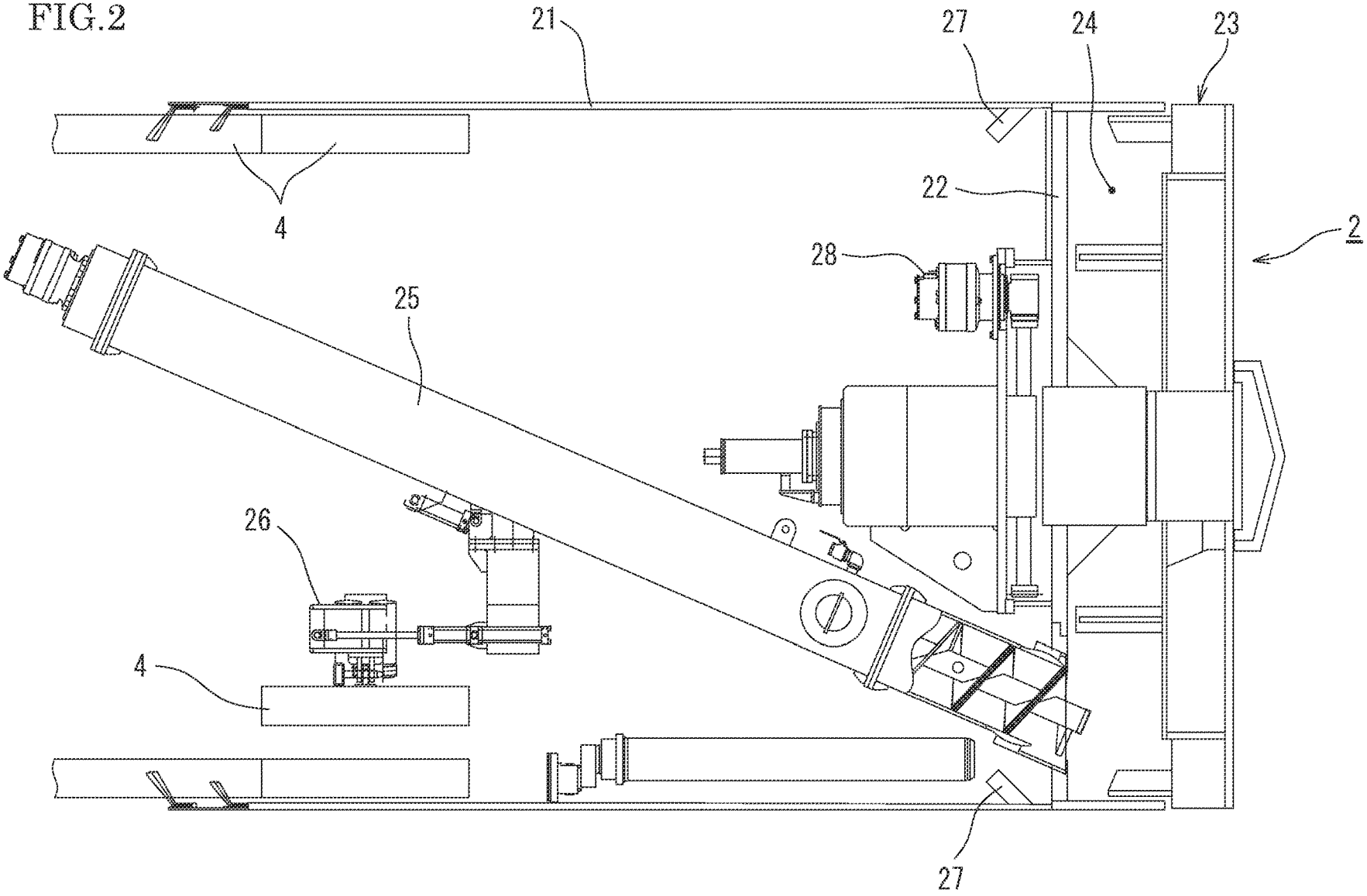
FIG. 2 is a diagram illustrating a schematic configuration of a shield machine in FIG. 1.

In this embodiment, the shield machine 2 is for a so-called mud pressure shield method, as exemplarily shown in FIG. 2. The shield machine 2 at least includes: an outer cylinder 21 that is called as a skin plate; a partition wall 22; a cutter head 23; a chamber 24; a screw conveyor 25; an erector 26; and a plurality of chemical feeding ports 27.

The cutter head 23 is provided in front of the partition wall 22 so as to excavate the ground. The cutter head 23 is rotary driven via a motor (hydraulic or electric) 28 and a speed reduction mechanism (not shown).

The chamber 24 is provided between the cutter head 23 and the partition wall 22 so as to accumulate excavated soil generated by excavation of the cutter head 23.

The screw conveyor 25 collects the excavated soil accumulated in the chamber 24 in a muddy water treatment plant on the ground (not shown). Muddy water generated by the muddy water treatment plant is supplied at high pressure to the chamber 24, and the screw conveyor 25 collects this supplied muddy water and the excavated soil.

The erector 26 builds segments 4 sequentially in a horizontal hole 5 that is excavated by the cutter head 23.

The chemical feeding port 27 is a pipe port that supplies appropriate sealant to stop water outflowing from the space between an entrance 12 and the shield machine 2 after opening the entrance 12 in an earth retaining wall 11 of a shaft 1. The chemical feeding port 27 is connected to an appropriate chemical feeding device (not shown).

Figure 5:
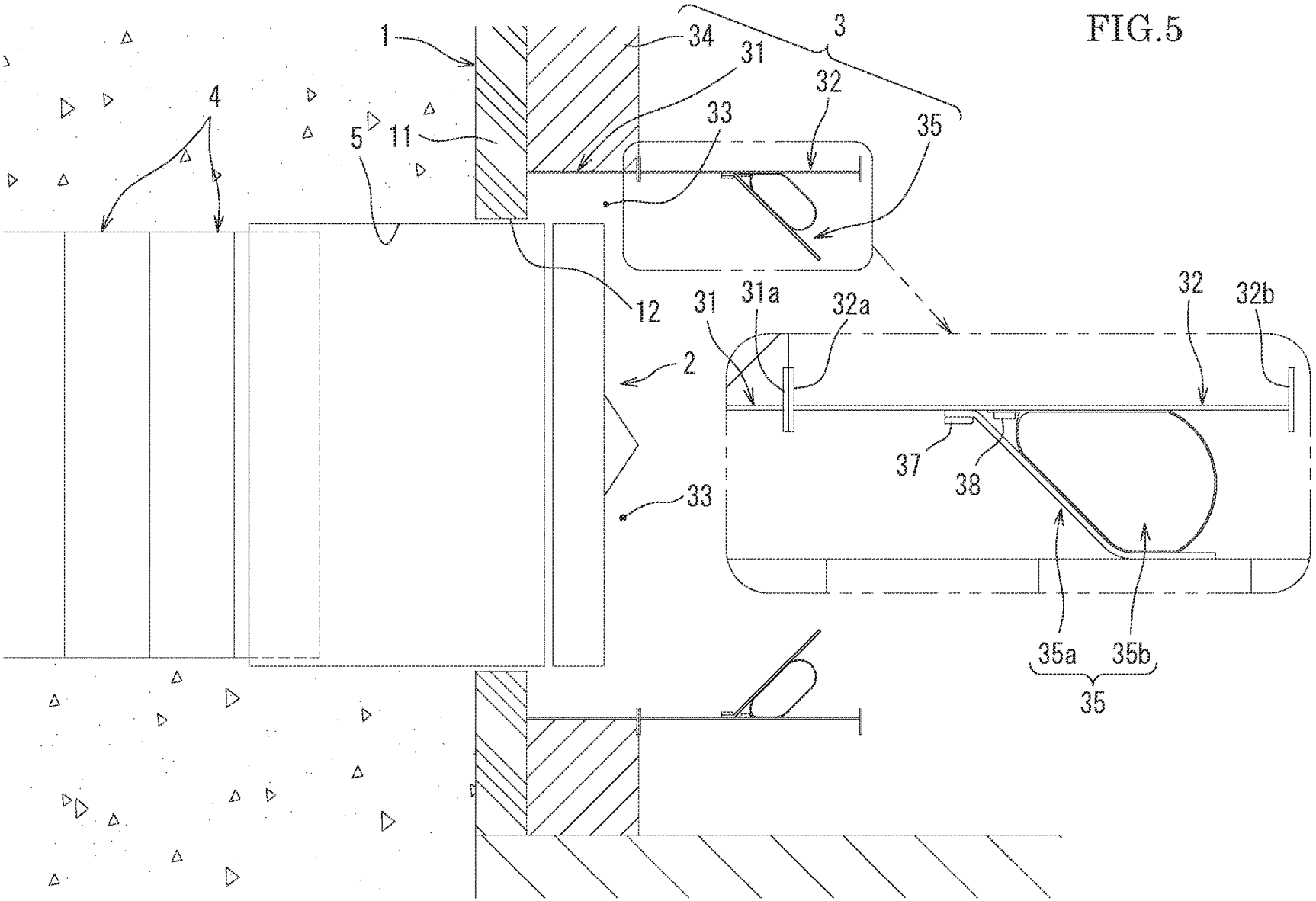
FIG. 5 is a cross-sectional view following FIG. 4, which illustrates a state in which a second cylindrical frame is provided.

As shown in FIG. 5, the entrance apparatus 3 at least includes a first cylindrical frame 31 and a second cylindrical frame 32.

The first cylindrical frame 31 is provided at a position where the entrance 12 is formed in the inner surface of the earth retaining wall 11 of the shaft 1 on the arrival side of the shield machine 2.

The first cylindrical frame 31 is made of, for example, a metal so as to have a cylindrical shape. An annular plate 31*a* is provided on the inner open end of the first cylindrical frame 31 so as to extend inside and outside in the radial direction.

The first cylindrical frame 31 has a largeness such that the shield machine 2 can enter the cylindrical frame 31 without making contact with the cylindrical frame 31. In this way, the space in the inner diameter of the first cylindrical frame 31 serves as an entrance space 33 that the shield machine 2 enters. An entrance concrete 34 is provided on the outer diameter side of the first cylindrical frame 31.

The second cylindrical frame 32 is coupled to the inner open end of the first cylindrical frame 31. The second cylindrical frame 32 is made of, for example, a metal so as to have a cylindrical shape. The inner diameter, the outer diameter and the outer shape of the second cylindrical frame 32 are the same as those of the first cylindrical frame 31.

Regarding this second cylindrical frame 32, a first end side annular plate 32*a* is provided on the open end that the shield machine 2 enters so as to extend inside and outside in the radial direction, and a second end side annular plate 32*b* is provided on the open end on the side opposite to the open end as the entering side so as to extend inside and outside in the radial direction.

The first end side annular plate 32*a* of the second cylindrical frame 32 is superimposed on the annular plate 31*a* of the first cylindrical frame 31 via a sealing component (not shown, e.g. packing) in the axis direction so as to be coupled to each other by the fastening member (not shown, e.g. bolts and nuts).

To the inner diameter side of the second cylindrical frame 32, a sealing member 35 is attached. As shown in FIG. 5 as an enlarged diagram, the sealing member 35 is made up of an elastic sheet 35*a*, an elastic tube 35*b* and a filling device (not shown).

The elastic sheet 35*a* is made of a material having flexibility and elasticity such as rubber so as to have a tapered shape. The left end part of the elastic sheet 35*a* is fixed to the middle area of the inner circumferential surface of the second cylindrical frame 32 by the fastening member (not shown, e.g. bolts and nuts) via a keep plate 37.

The elastic tube 35*b* and the filling device (not shown) constitute a pressurizing member recited in the scope of claims. The pressurizing member further bends the tapered-shaped elastic sheet 35*a* obliquely inward in the radial direction so that the inner circumferential part of the elastic sheet 35*a* is pressed against the outer circumferential surface of the shield machine 2 and the outer circumferential surface of the segment 4.

The elastic tube 35*b* expands as the inside thereof is filled with fluid (such as water and air). The elastic tube 35*b* is provided on the outer diameter side of the elastic sheet 35*a*. The elastic tube 35*b* is fixed to the inner circumferential surface of the second cylindrical frame 32 by the fastening member (not shown, e.g. bolts and nuts) via a keep plate 38.

The filling device (not shown) reduces the diameter of the elastic sheet 35*a* by filling the elastic tube 35*b* with fluid (such as water and air) via a supply pipe (not shown) from a turbine pump (not shown).

In the sealing member 35, when the elastic sheet 35*a* is bent obliquely inward in the radial direction due to expansion of the elastic tube 35*b* with the supplied fluid, the inner diameter of the elastic sheet 35*a* becomes smaller than the outer diameter of the shield machine 2 and the outer diameter of the segments 4 constituting the outer shell of the tunnel. As a result, the elastic sheet 35*a* is pressed against the outer circumferential surface of the shield machine 2 and the outer circumferential surface of the segments 4.

Now, the one embodiment of the shield method of the present invention is described further in detail.

Before construction, the ground is surveyed to determine whether the soil where the tunnel is built should be improved or not, that is, whether the ground is stable or unstable.

Generally, geology of the ground, moisture content and the like are defined, according to appropriate criteria, as the indices to determine whether the soil improvement is necessary or not.

The geology is represented, for example, by the soil retention strength. That is, in the case of the hard ground that hardly crumbles (such as firm gravel soil and lithoid soil), the soil retention strength is high and the ground is stable. On the other hand, in the case of the soft ground that easily crumbles (such as loose sandy soil containing a large amount of spring water and/or ground water and soft clay soil), the soil retention strength is low and the ground is unstable.

In addition to the above, in the case where it is indispensable to avoid the risk of ground subsidence and the like (for example, in the case where a building is constructed on the ground right above or above the vicinity of the construction location of the tunnel), it is determined that the soil improvement is needed.

(First Shield Method)

Here, the first shield method is described with reference to FIGS. 1 to 7. The first shield method is suitable for the case where the ground is stable. In this method, the operation is conducted without the soil improvement. However, an appropriate soil improvement (see the second shield method described later) may be carried out.

Figure 1:
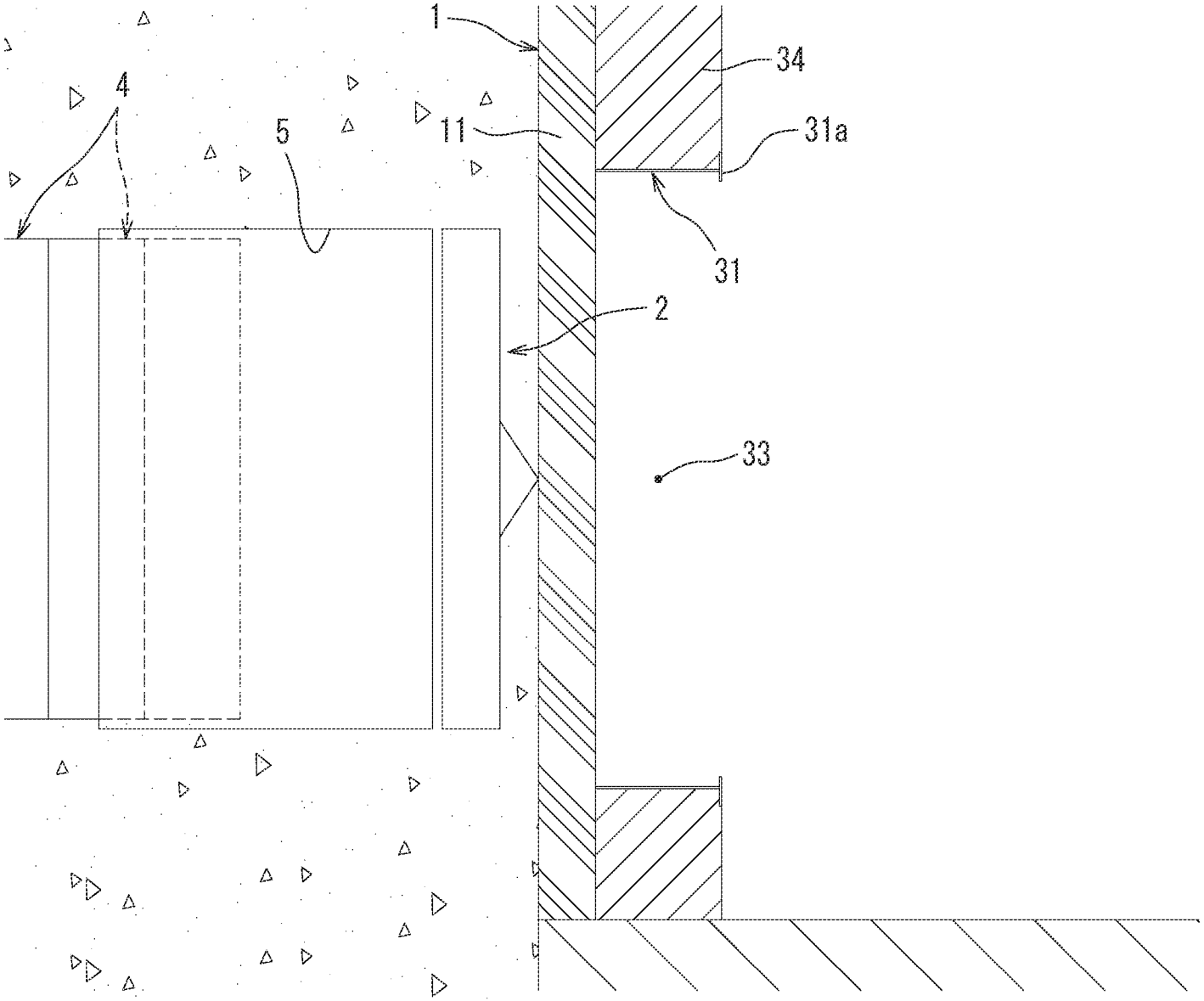
FIG. 1 is a cross-sectional view for explaining a first step of providing a first cylindrical frame on an arrival shaft according to an embodiment of a shield method of the present invention.

As shown in FIG. 1, the first cylindrical frame 31 is provided at a position where the entrance 12 is to be formed in the inner surface of the earth retaining wall 11 of the shaft 1 on the arrival side of the shield machine 2 (a first step). Here, the entrance concrete 34 is provided on the outer diameter side of the first cylindrical frame 31.

Figure 3:
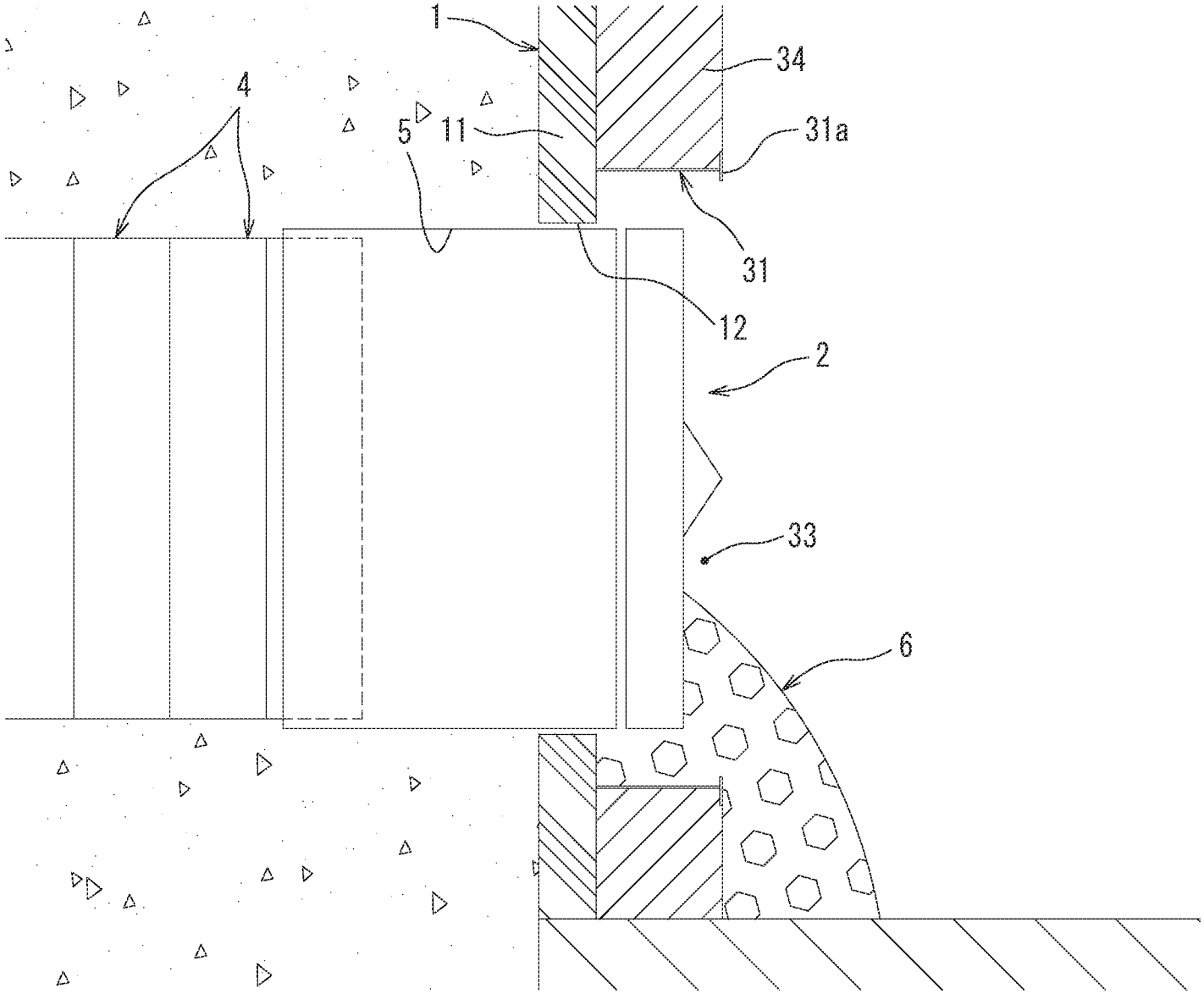
FIG. 3 is a cross-sectional view following FIG. 1, which illustrates a state just after opening an entrance in an earth retaining wall of the shaft by the shield machine.

Then, as the shield machine 2 excavates the horizontal hole 5 in the underground, the plurality of segments 4 that serves as the outer shell of the tunnel is sequentially added and built in the excavation direction on the inner diameter side of the horizontal hole 5 as shown in FIG. 3, while a back-filling material is injected into the gap between the horizontal hole 5 and the segments 4 (not shown). Furthermore, after forming the entrance 12 in the arrival shaft 1, the shield machine 2 is stopped so as to stay in the entrance 12. After that, a measure to temporarily stop water is applied to the gap between the inner circumference of the entrance 12 and the outer circumferential surface of the shield machine 2 (not shown) (a second step).

When the horizontal hole 5 is excavated, the excavated soil is collected in the chamber 24 of the shield machine 2 and discharged from the screw conveyor 25 to the outside of the horizontal hole 5.

Figure 4:
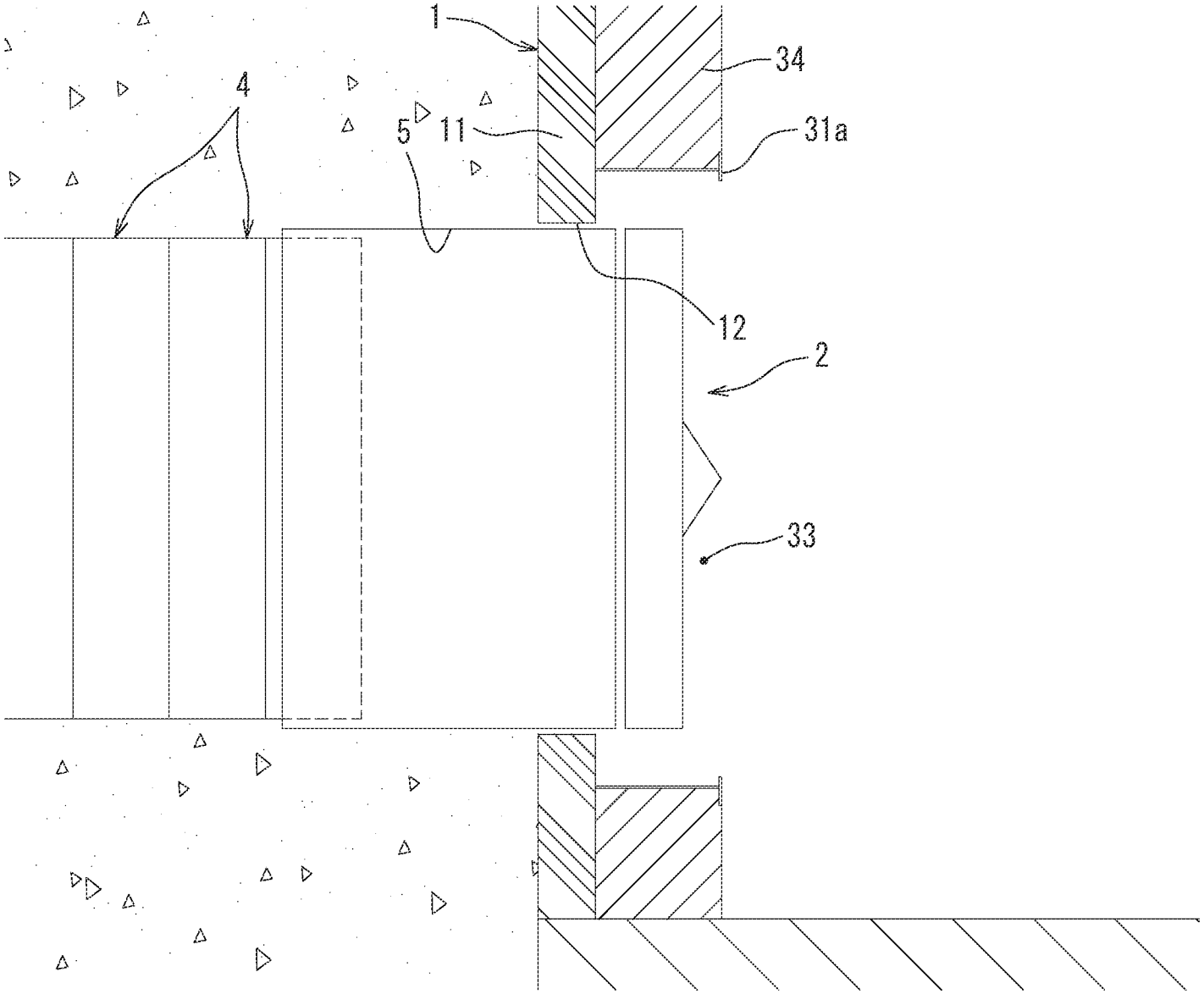
FIG. 4 is a cross-sectional view illustrating a state in which excavated soil and pieces are removed from the state in FIG. 3.

Successively, excavated soil and pieces 6 that enter the entrance space 33 as a result of forming the entrance 12 (see FIG. 3) are removed, as shown in FIG. 4 (a third step).

As to the measure to temporarily stop water, it is possible, for example, to inject sealant (not shown, chemical agents such as a polymer based agent, a water glass based agent, and a mortar based agent) from the chemical feeding port 27 of the shield machine 2 into the gap.

Successively as shown in FIG. 5, the second cylindrical frame 32 is coupled to the inner open end of the first cylindrical frame 31 (a fourth step). Here, the first end side annular plate 32*a* of the second cylindrical frame 32 is superimposed on the annular plate 31*a* of the first cylindrical frame 31 via a sealing component (not shown, e.g. packing) in the axis direction so as to be fixed to each other by the fastening member (not shown, e.g. bolts and nuts).

Figure 6:
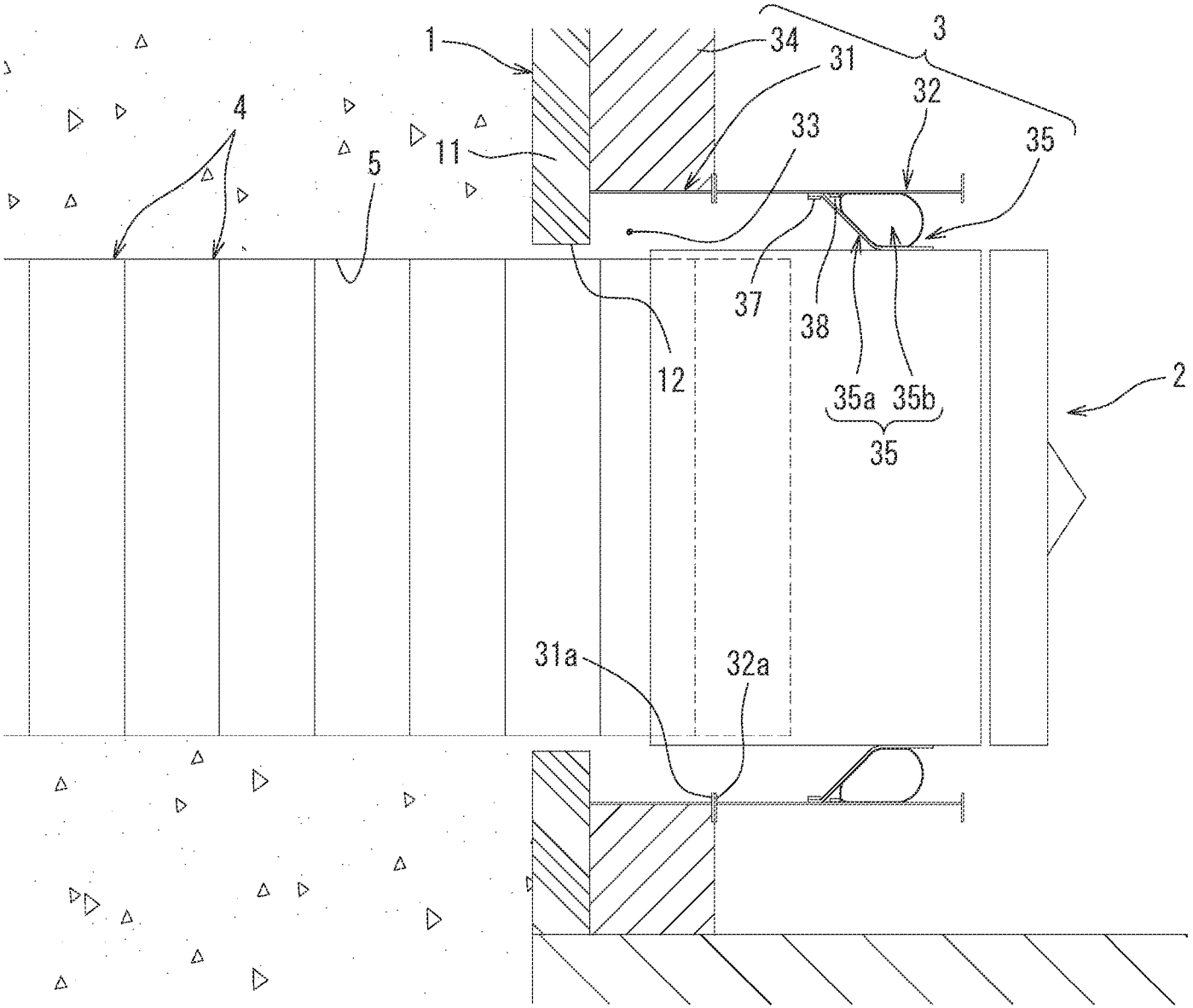
FIG. 6 is a cross-sectional view following FIG. 5, which illustrates a state in which the shield machine enters the second cylindrical frame so as to come into contact with a sealing member.

Then, after the shield machine 2 goes beyond the sealing member 35 as shown in FIG. 6, the fluid is supplied from the filling device (not shown) to the elastic tube 35*b* of the sealing member 35 and accordingly the elastic tube 35*b* is expanded. Thus, the elastic sheet 35*a* of the sealing member 35 is pressed against the outer circumferential surface of the shield machine 2 (a fifth step).

Figure 7:
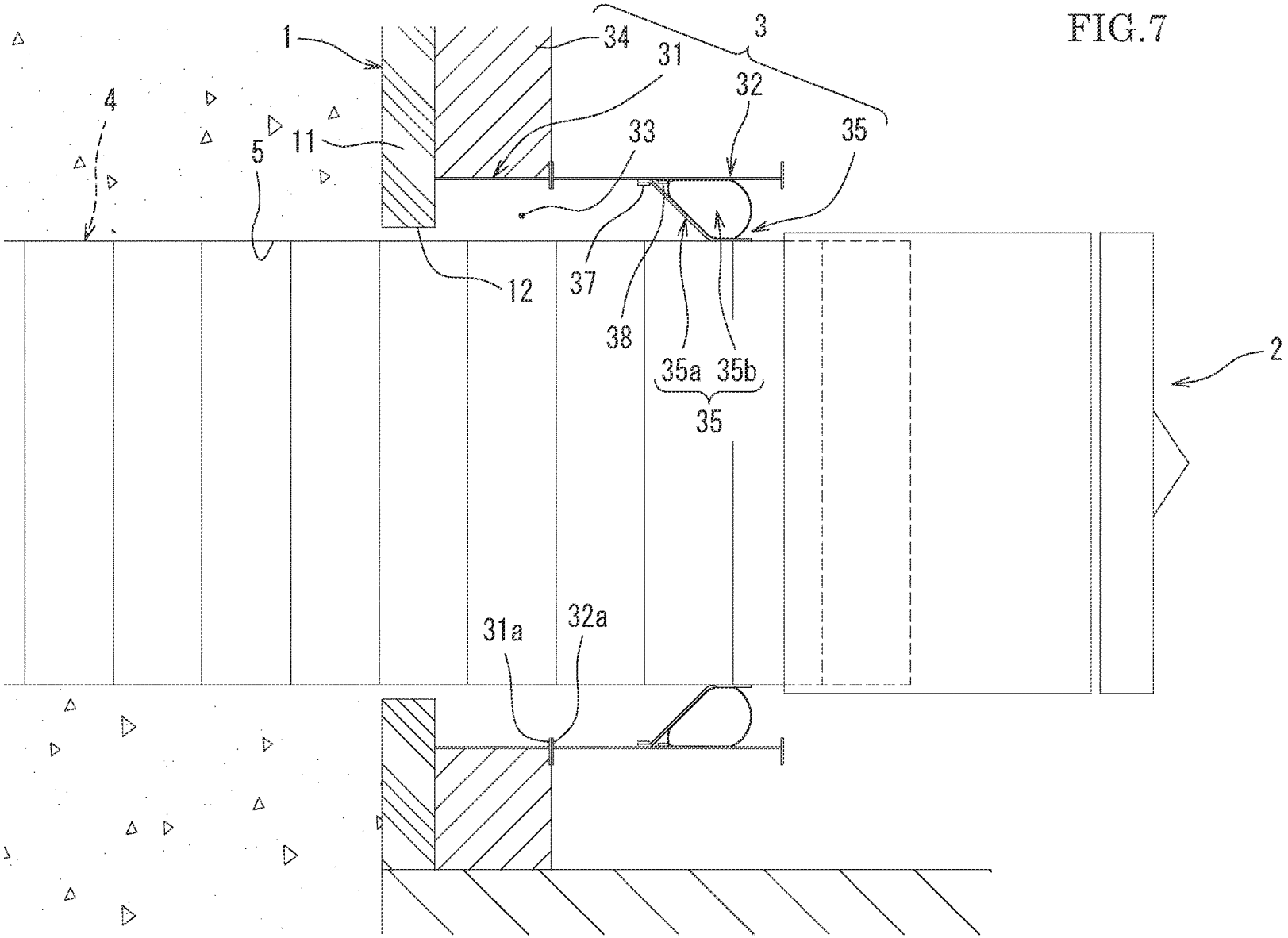
FIG. 7 is a cross-sectional view following FIG. 6, which illustrates a state in which the shield machine further advances so that a segment comes into contact with the sealing member.

Successively as shown in FIG. 7, when the shield machine 2 moves further forward and reaches the location where the outer circumferential surface of the segments 4 comes into contact with the elastic sheet 35*a* of the sealing member 35, the fluid is further supplied from the filling device (not shown) to the elastic tube 35*b*. Thus, the elastic sheet 35*a* is further tightly pressed against the outer circumferential surface of the segments 4 (a sixth step).

When all the above-described steps are finished, the shield machine 2 is placed, for example, on a bogie for drawing (not shown) and is removed from the second cylindrical frame 32.

With the first shield method as described above, it is possible to use the entrance apparatus 3 having a relatively simple structure including the first cylindrical frame 31 and the second cylindrical frame 32 so as to form the entrance 12 quickly and safely in the earth retaining wall 11 of the arrival shaft 1. It is also possible to prevent the excavated soil and pieces 6 from getting stuck in the sealing member 35 of the second cylindrical frame 32.

Thus, it is possible to ensure a desired water-stopping effect by the sealing member 35 while reducing construction expenses and ensuring work safety.

(Second Shield Method)

Here, the second shield method is described with reference to FIGS. 8 to 13. The second shield method is suitable for the case where the ground is unstable or the case where it is desired to reliably avoid any possible risk.

In this method, the soil is appropriately improved in advance such that the soil is reliably stable and does not crumble when the horizontal hole 5 is excavated in the underground.

Figure 8:
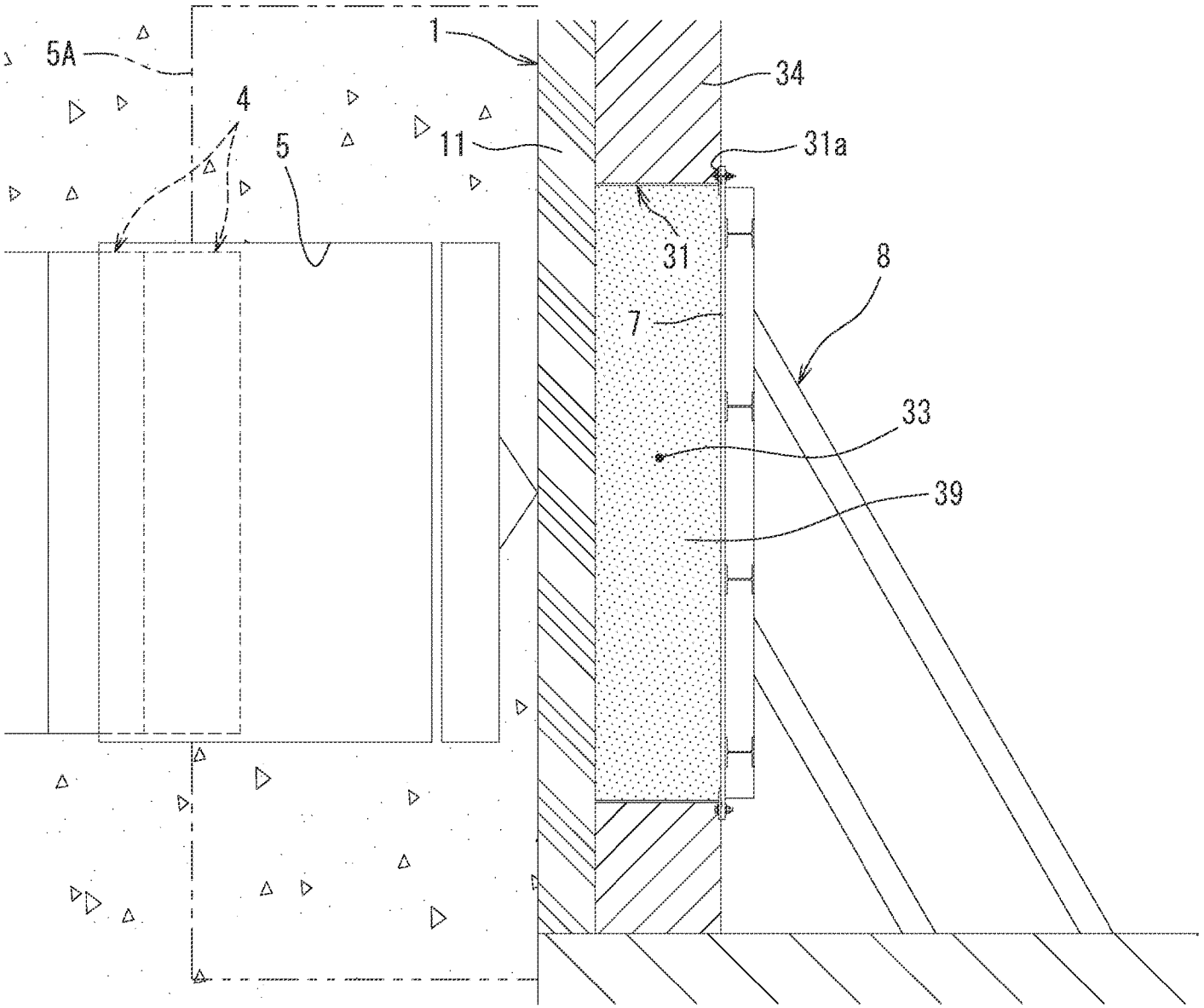
FIG. 8 is a cross-sectional view illustrating a state in which the first cylindrical frame and a temporary lid are provided on the arrival shaft according to another embodiment of the shield method of the present invention.

As to the method for improving the soil, a method exemplarily shown in FIG. 8 is publicly known. That is, in the underground, chemical liquid, cement mill and/or freezing agent is/are injected into a predetermined outer circumferential area (also referred to as a "soil improvement area") 5A at the position where the entrance is to be formed in the earth retaining wall 11 of the shaft 1. It is preferable that the width (i.e. the size along the direction of travel of the shield machine 2) and the size in the radial direction of the soil improvement area 5A are appropriately set based on the total length of the shield machine 2, depending on the unstableness of the ground.

The shield machine 2 that is used in this shield method preferably includes, apart from the above-described elements, a filling device (not shown) for filling the entrance space 33 with a filler 39 (for example, sand, muddy water, and freezing agent), as shown in FIG. 8.

First, as shown in FIG. 8, the first cylindrical frame 31 is provided at a position where the entrance is to be formed in the inner surface of the earth retaining wall 11 of the shaft 1 on the arrival side of the shield machine 2 (a first step). Here, the entrance concrete 34 is provided on the outer diameter side of the first cylindrical frame 31.

Then, a temporary lid 7 is provided on the inner open end of the first cylindrical frame 31 such that the entrance space 33 on the inner diameter side of the first cylindrical frame 31 is closed by the temporary lid 7 and the earth retaining wall 11. The entrance space 33 is filled with the filler 39 by the filling device (not shown) (a first auxiliary step). Further, a back anchor (also referred to as a "reaction forth supporting material") 8 is attached to the temporary lid 7.

In this way, when the entrance space 33 is sealed and filled with the filler 39, the internal pressure of the entrance space 33 is made equal to or higher than the underground pressure. Thus, it is possible to reduce/prevent large cracking of the earth retaining wall 11 when the shield machine 2 forms the entrance 12 in the earth retaining wall 11 of the shaft 1.

In the case where the internal pressure of the entrance space 33 increases due to entry of the shield machine 2, the filler 39 in the entrance space 33 is discharged outside by the filling device (not shown) provided in the shield machine 2. Thus, the internal pressure of the entrance space 33 is maintained to be a predetermined pressure.

Figure 9:
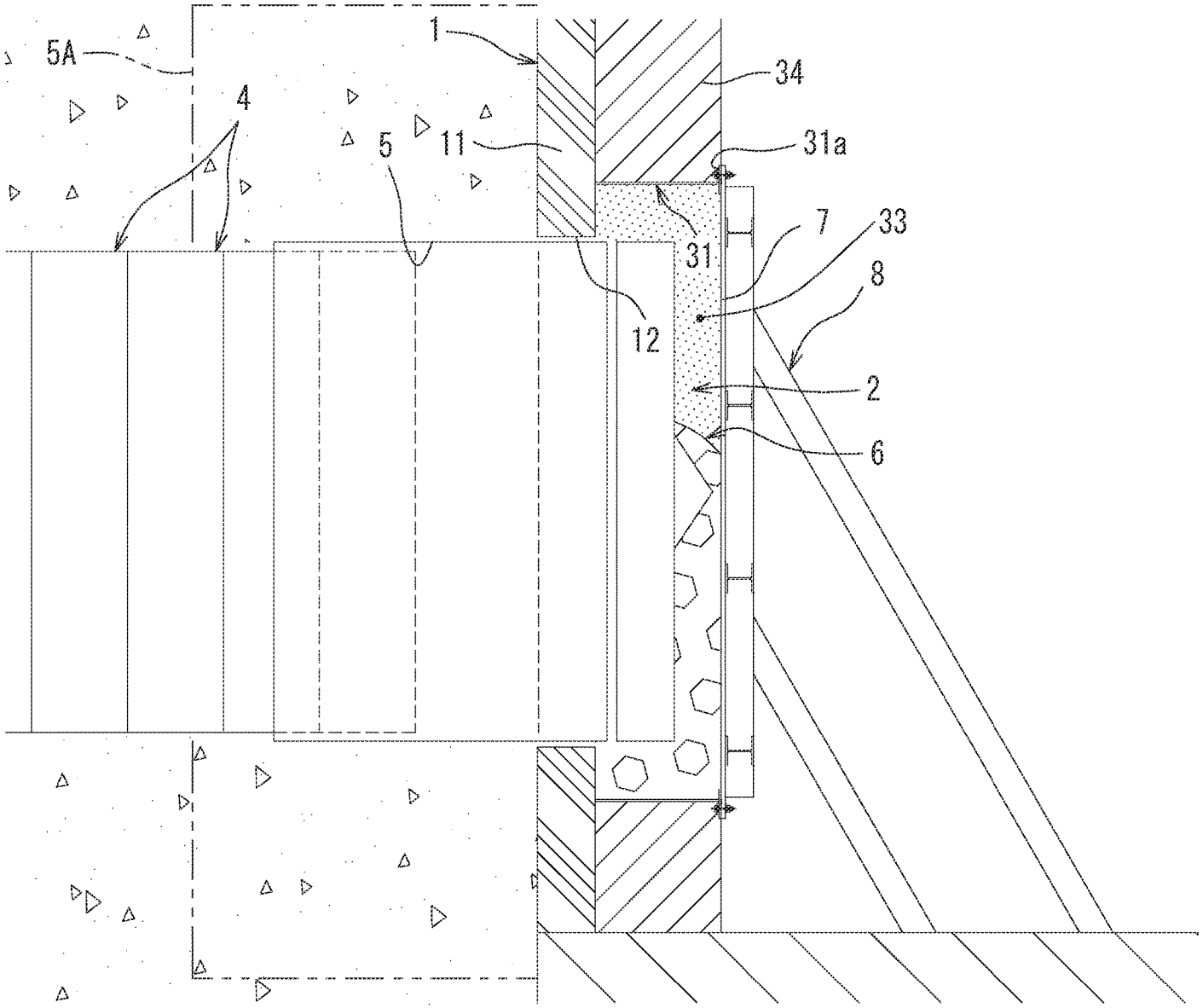
FIG. 9 is a cross-sectional view following FIG. 8, which illustrates a state just after opening an entrance in the earth retaining wall of the shaft by the shield machine.

Then, as the shield machine 2 excavates the horizontal hole 5 in the underground, the plurality of segments 4 that serves as the outer shell of the tunnel is sequentially added and built in the excavation direction on the inner diameter side of the horizontal hole 5 as shown in FIG. 9, while a back-filling material is injected into the gap between the horizontal hole 5 and the segments 4 (not shown). Furthermore, after forming the entrance 12 in the arrival shaft 1, the shield machine 2 is stopped so as to stay in the entrance 12. After that, a measure to temporarily stop water is applied to the gap between the inner circumference of the entrance 12 and the outer circumferential surface of the shield machine 2 (not shown) (a second step).

When the horizontal hole 5 is excavated, the excavated soil is collected in the chamber 24 of the shield machine 2 and discharged from the screw conveyor 25 to the outside of the horizontal hole 5.

Figure 10:
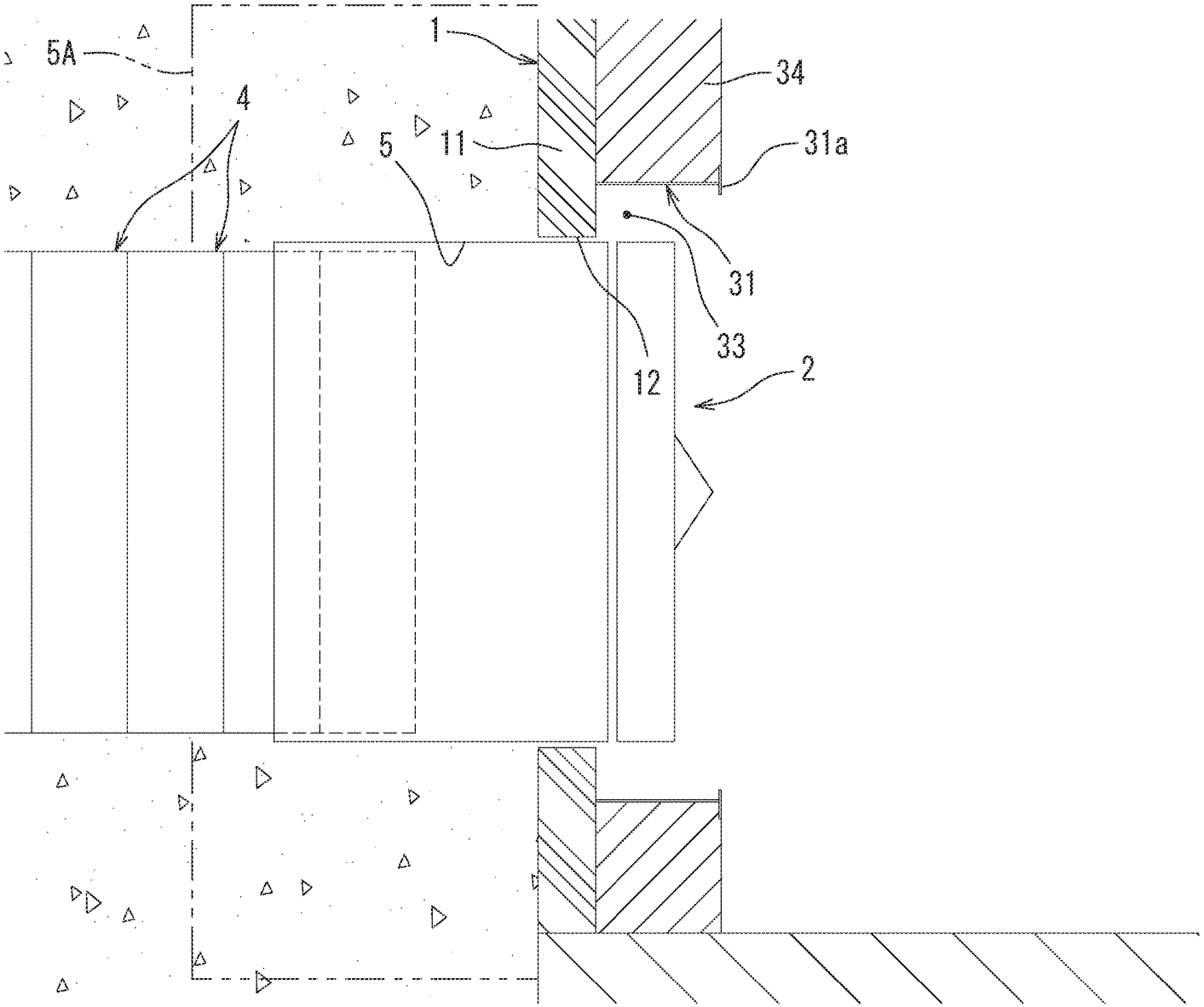
FIG. 10 is a cross-sectional view illustrating a state in which a filler and excavated soil and pieces are removed from the state in FIG. 9 by removing the temporary lid.

After that, as shown in FIG. 10, the temporary lid 7 and the back anchor 8 are removed (a second auxiliary step).

Successively, the excavated soil and pieces 6 that enter the entrance space 33 as a result of forming the entrance 12 (see FIG. 9) are removed (a third step).

As to the measure to temporarily stop water, it is possible, for example, to inject sealant (not shown, chemical agents such as a polymer based agent, a water glass based agent, and a mortar based agent) from the chemical feeding port 27 of the shield machine 2 into the gap.

Figure 11:
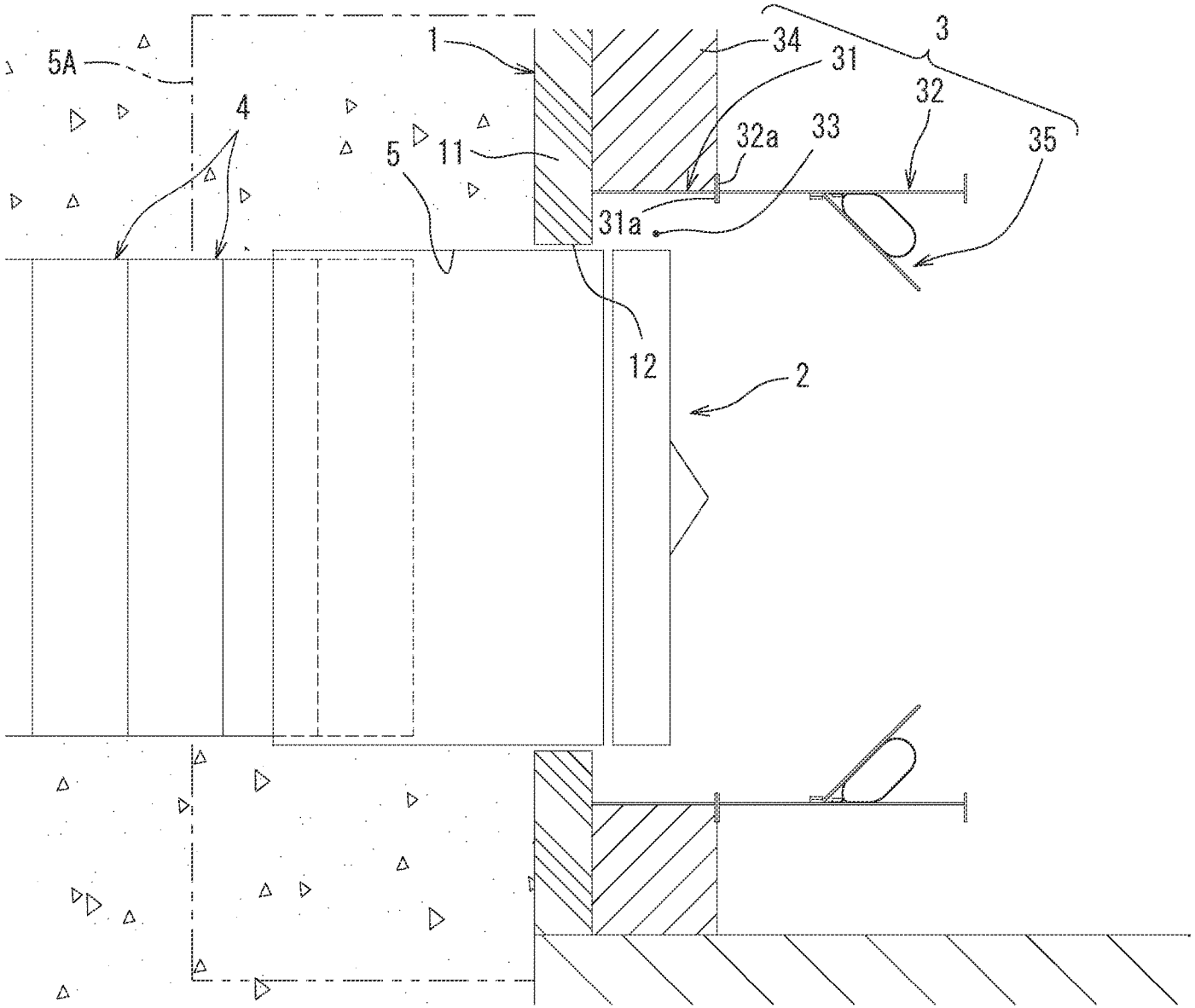
FIG. 11 is a cross-sectional view following FIG. 10, which illustrates a state in which the second cylindrical frame is provided.

Successively as shown in FIG. 11, the second cylindrical frame 32 is coupled to the inner open end of the first cylindrical frame 31 (a fourth step). Here, the first end side annular plate 32*a* of the second cylindrical frame 32 is superimposed on the annular plate 31*a* of the first cylindrical frame 31 via a sealing component (not shown, e.g. packing) in the axis direction so as to be fixed to each other by the fastening member (not shown, e.g. bolts and nuts).

Figure 12:
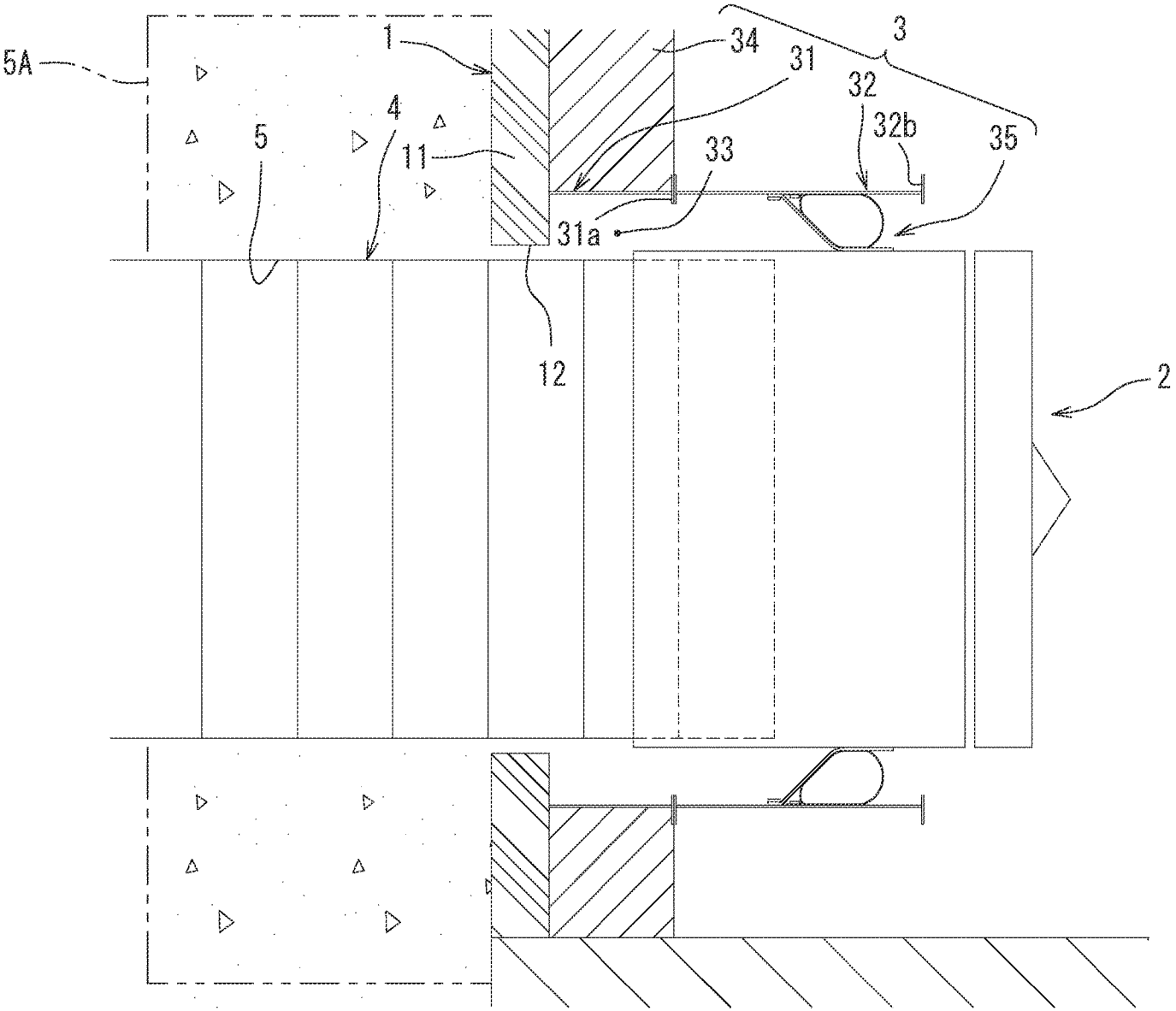
FIG. 12 is a cross-sectional view following FIG. 11, which illustrates a state in which the shield machine enters the second cylindrical frame so as to come into contact with the sealing member.

Then, after the shield machine 2 goes beyond the sealing member 35 as shown in FIG. 12, the fluid is supplied from the filling device (not shown) to the elastic tube 35*b* of the sealing member 35 and accordingly the elastic tube 35*b* is expanded. Thus, the elastic sheet 35*a* of the sealing member 35 is pressed against the outer circumferential surface of the shield machine 2 (a fifth step).

Figure 13:
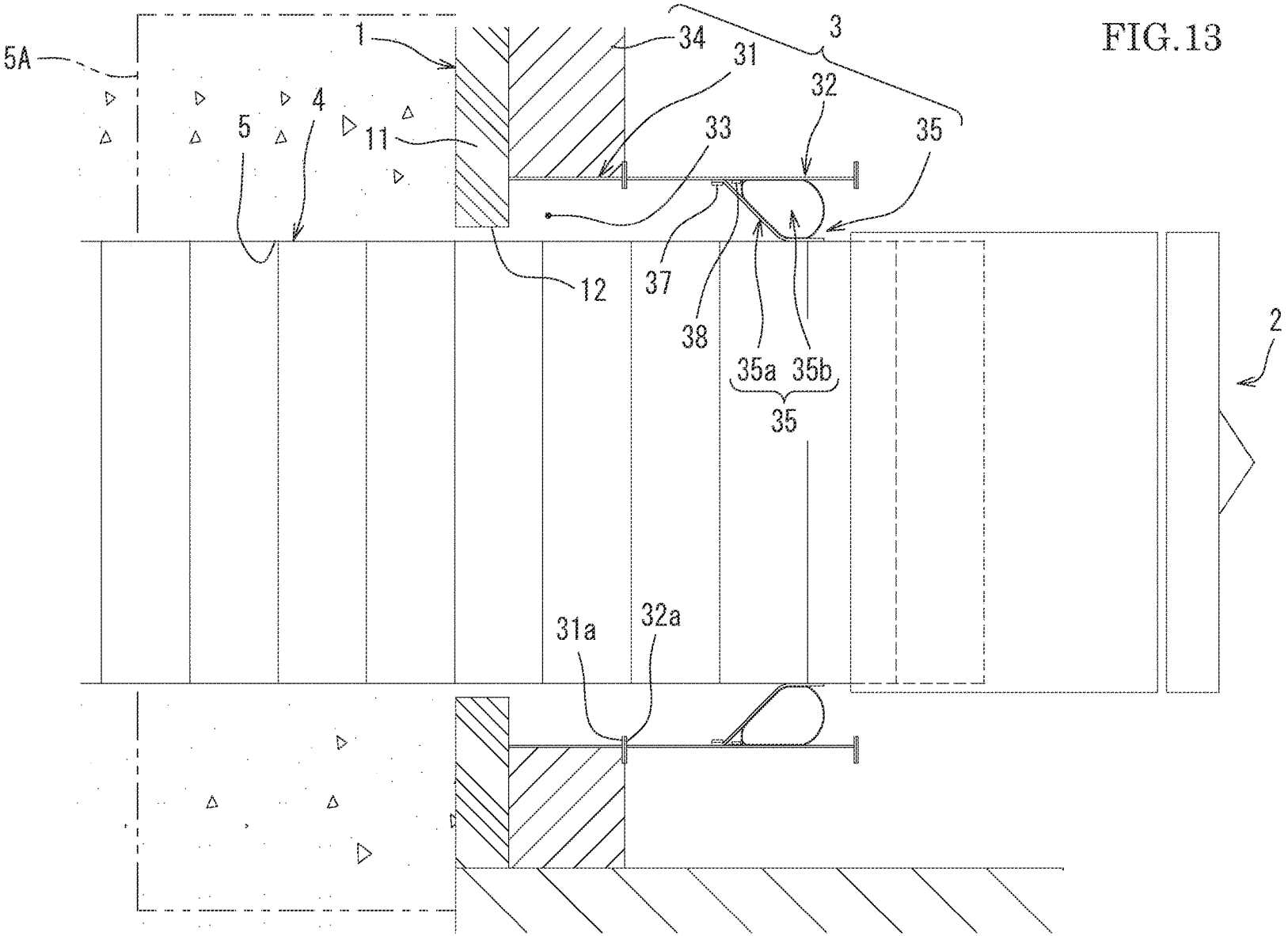
FIG. 13 is a cross-sectional view following FIG. 12, which illustrates a state in which the shield machine further advances so that the segment comes into contact with the sealing member.

Successively as shown in FIG. 13, when the shield machine 2 moves further forward and reaches the location where the outer circumferential surface of the segments 4 comes into contact with the elastic sheet 35*a* of the sealing member 35, the fluid is further supplied from the filling device (not shown) to the elastic tube 35*b*. Thus, the elastic sheet 35*a* is further tightly pressed against the outer circumferential surface of the segments 4 (a sixth step).

When all the above-described steps are finished, the shield machine 2 is placed, for example, on a bogie for drawing (not shown) and is removed from the second cylindrical frame 32.

With the second shield method as described above, it is possible to use the entrance apparatus 3 having a relatively simple configuration including the first cylindrical frame 31, the second cylindrical frame 32 and the temporary lid 7 so as to form the entrance 12 quickly and safely in the earth retaining wall 11 of the arrival shaft 1 while preventing the arrival shaft 1 from crumbling. Also it is possible to prevent the excavated soil and pieces 6 from getting stuck in the sealing member 35 of the second cylindrical frame 32.

Thus, it is possible to ensure a desired water-stopping effect by the sealing member 35 while reducing construction expenses and ensuring work safety.

(Third Shield Method)

The third shield method is based on the above-described second shield method, and also has a third auxiliary step and a fourth auxiliary step. The third shield method is suitable for the case where the ground is unstable or the case where it is desired to reliably avoid any possible risk.

More specifically, in the third shield method, after performing the first step to the third step of the above-described second shield method, a third auxiliary step is carried out before advancing to the fourth step and the fifth step. As exemplarily shown in FIG. 14, in the third auxiliary step, a temporary lid 9 is provided on the inner open end of the second cylindrical frame 32 via an extended cylindrical frame 36 having, for example, a cylinder shape.

A back anchor (also referred to as a "reaction forth supporting material") 10 is attached to the temporary lid 9. It is possible to reuse the temporary lid 7 and the back anchor 8 that are used in the first auxiliary step of the second shield method respectively as the temporary lid 9 and the back anchor 10.

In the third auxiliary step, a first end side annular plate 36*a* of the extended cylindrical frame 36 is superimposed on the second end side annular plate 32*b* of the second cylindrical frame 32 via a sealing component (not shown, e.g. packing) in the axis direction so as to be fixed to each other by the fastening member (not shown, e.g. bolts and nuts). The temporary lid 9 is fixed to a second end side annular plate 36*b* of the extended cylindrical frame 36 by the fastening member (not shown, e.g. bolts and nuts). The back anchor (also referred to as a "reaction forth supporting material") 10 is attached to the temporary lid 9.

In the third auxiliary step, it is possible to balance the internal pressure of the entrance space 33 and the underground pressure by supplying water or muddy water into the entrance space 33.

However, in the third auxiliary step, the water or the muddy water is not necessarily supplied into the entrance space 33. Also, if the total length of the shield machine 2 is small, the extended cylindrical frame 36 is not needed to be fixed to the second cylindrical frame 32.

After performing the third auxiliary step, the procedure advances to the fifth step (see FIG. 12) described in the second shield method. That is, after the shield machine 2 goes beyond the sealing member 35, the fluid is supplied from the filling device (not shown) to the elastic tube 35*b* of the sealing member 35 and accordingly the elastic tube 35*b* is expanded. Thus, the elastic sheet 35*a* of the sealing member 35 is pressed against the outer circumferential surface of the shield machine 2.

After carrying out the fifth step, the temporary lid 9 and the back anchor 10 are removed (a fourth auxiliary step). Successively, similarly to the sixth step of the second shield method, when the shield machine 2 moves further forward and reaches the position where the outer circumferential surface of the segments 4 comes into contact with the elastic sheet 35*a* of the sealing member 35 (see the long dashed double-short dashed line in FIG. 14), the fluid is further supplied from the filling device (not shown) to the elastic tube 35*b*. Thus, the elastic sheet 35*a* is further tightly pressed against the outer circumferential surface of the segments 4 (the sixth step).

When all the above-described steps are finished, the shield machine 2 is placed, for example, on a bogie for drawing (not shown) and is removed from the second cylindrical frame 32.

With the third shield method as described above, it is possible to obtain the same function and effect as those obtained by the second shield method. In addition, even if spring water, groundwater or muddy water enters the entrance space 33 from the ground in the fifth step, it is possible to prevent the spring water, the groundwater or the muddy water from leaking out into the shaft 1.

The present invention is not limited to the foregoing embodiments, and all modifications and changes that come within the meaning and range of equivalency of the claims are intended to be embraced therein.

(1) In the second and third shield methods, the soil is improved. However, the present invention is not limited thereto. For example, the soil is not necessarily improved, although this case is not shown in the drawings.

(2) In the second and third shield methods, the entrance space 33 is filled with the filler 39 in the first auxiliary step. However, the present invention is not limited thereto.

For example, the entrance space 33 is not necessarily filled with the filler 39 in the first auxiliary step, although this case is not shown in the drawings.

Figure 15:
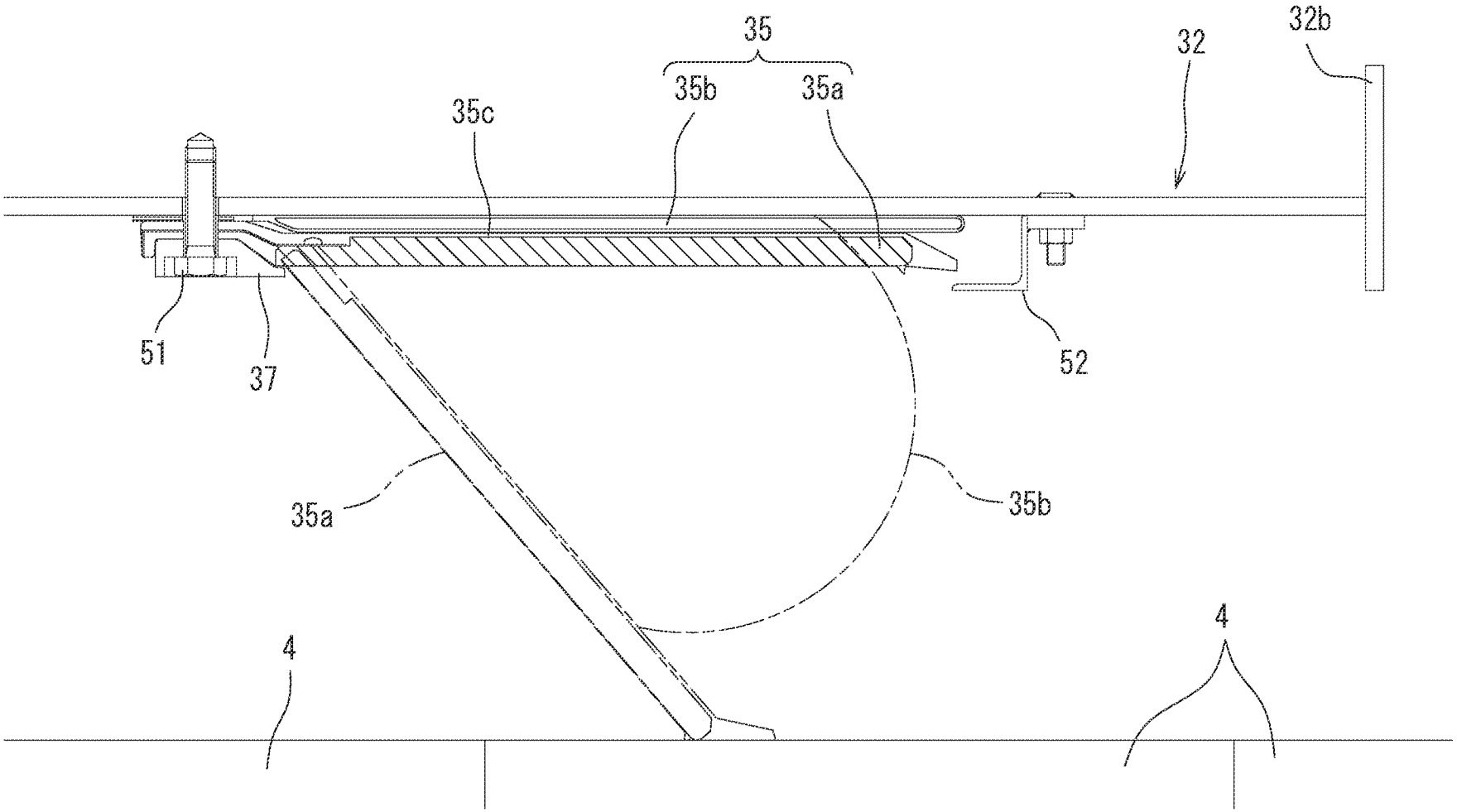
FIG. 15 is a diagram illustrating another example of the sealing member.
Figure 16:
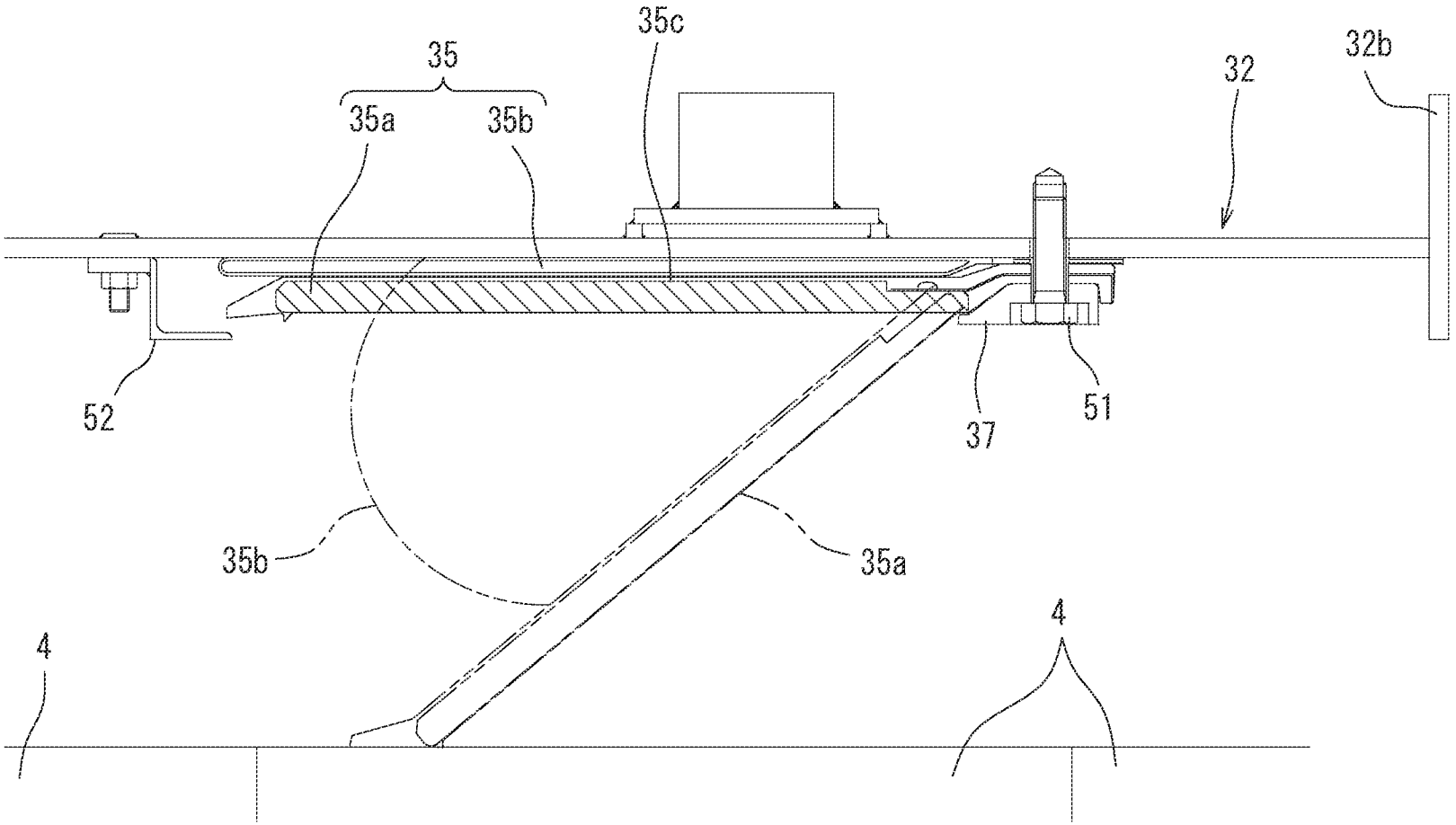
FIG. 16 is a diagram illustrating another example of the sealing member.
Figure 17:
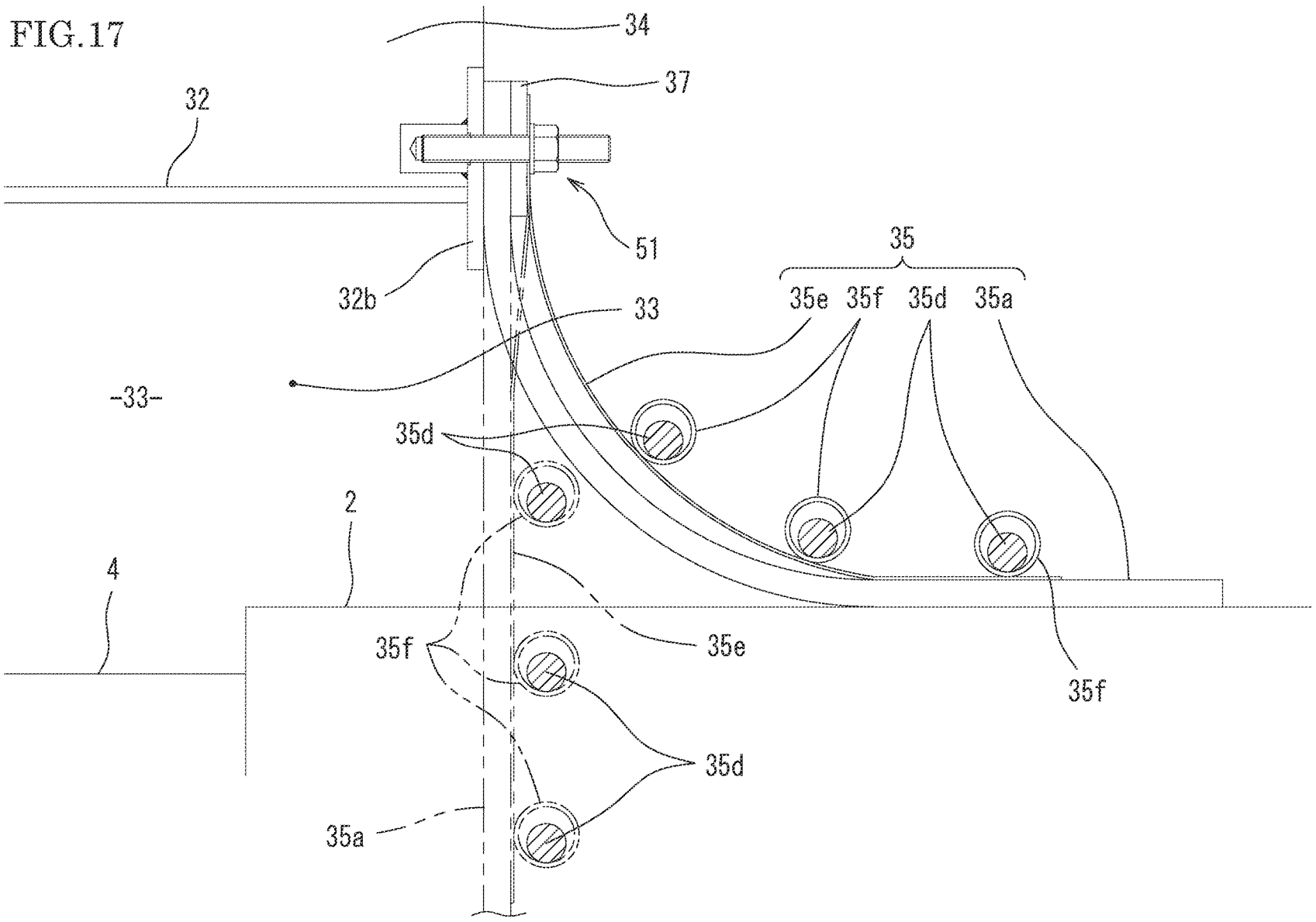
FIG. 17 is a diagram illustrating another example of the sealing member.

(3) The sealing member 35 used in the first to third shield methods may be replaced with one of the various kinds of sealing members 35 as exemplarily shown in FIGS. 15 to 17.

The sealing member 35 as shown in FIG. 15 includes the elastic sheet 35*a*, the elastic tube 35*b* and a filling device (not shown).

The elastic sheet 35*a* is made of a material having flexibility and elasticity such as rubber so as to have a cylindrical shape along the inner circumferential surface of the second cylindrical frame 32. A plurality of band-like reinforcing plates 35*c*, which is made of a metal, is integrally fixed to respective parts of the outer circumferential surface of the elastic sheet 35*a* in the circumferential direction.

The left end part of the elastic sheet 35*a* is fixed to the middle area of the inner circumferential surface of the second cylindrical frame 32 by the fastening member (e.g. bolts and the like) 51 via the keep plate 37.

To a part of the second cylindrical frame 32 in the vicinity of the right end part of the elastic sheet 35*a*, an engaging member 52 is attached by the fastening member (not shown and not having the reference numeral, e.g. bolts and nuts).

When the elastic sheet 35*a* is in the unused state along the inner circumferential surface of the second cylindrical frame 32, the right end part of the elastic sheet 35*a* is engaged with the engaging member 52. That is, the unused state of the elastic sheet 35*a* is maintained by engaging the right end part of the elastic sheet 35*a* with the engaging member 52 while the elastic sheet 35*a* can be obliquely inclined by disengaging the right end part of the elastic sheet 35*a* from the engaging member 52.

The elastic tube 35*b* and the filling device (not shown) constitute the pressurizing member. The pressurizing member further bends the tapered-shaped elastic sheet 35*a* obliquely inward in the radial direction as indicated by the long dashed double-short dashed line, so that the inner circumferential part of the elastic sheet 35*a* is pressed against the outer circumferential surface of the shield machine 2 and the outer circumferential surface of the segment 4.

The elastic tube 35*b* expands as the inside thereof is filled with fluid (such as water and air). The elastic tube 35*b* is provided on the outer diameter side of the elastic sheet 35*a*. The elastic tube 35*b* is fixed to the inner circumferential surface of the second cylindrical frame 32 by the fastening member (not shown, e.g. bolts and nuts) via the keep plate 38.

The filling device obliquely inclines the elastic sheet 35*a* and reduces the diameter thereof by filling the elastic tube 35*b* with fluid (such as water and air) via a supply pipe from a turbine pump (not shown).

In the sealing member 35, when the elastic sheet 35*a* is bent obliquely inward in the radial direction due to expansion of the elastic tube 35*b* with the supplied fluid, the inner diameter of the elastic sheet 35*a* becomes smaller than the outer diameter of the shield machine 2 and the outer diameter of the segments 4 constituting the outer shell of the tunnel. As a result, the elastic sheet 35*a* is pressed against the outer circumferential surface of the shield machine 2 and the outer circumferential surface of the segments 4.

The sealing member 35 shown in FIG. 16 has the elastic sheet 35*a* whose orientation is opposite of that of the sealing member 35 shown in FIG. 15. The configuration except for the above is basically the same as the sealing member 35 shown in FIG. 15.

Specifically, the right end part of the elastic sheet 35*a* is fixed to the middle area of the inner circumferential surface of the second cylindrical frame 32 by the fastening member (such as bolts) via the keep plate 37.

The sealing member 35 shown in FIG. 17 includes the elastic sheet 35*a*, a plurality of wires 35*d*, and a wire holding member 35*e*.

The elastic sheet 35*a* has a shape extending along the radial direction, and its inner diameter is smaller than the outer diameter of the shield machine 2 and the outer diameter of the segments 4 assembled to have a cylinder shape.

The wires 35*d* are held by the wire holding member 35*e* so as to be mounted on the outer surface of the elastic sheet 35*a* (i.e. on the farther side from the entrance 12) in a manner of being arranged at predetermined intervals.

The same number of protective tubes 35*f* as the wires 35*d* are provided integrally on the outer surface (i.e. the opposite surface to the surface to come into contact with the elastic sheet 35*a*) of the wire holding member 35*e*. Each wire 35*d* is inserted into and thus held by the corresponding protective tube 35*f*.

Figure 14:
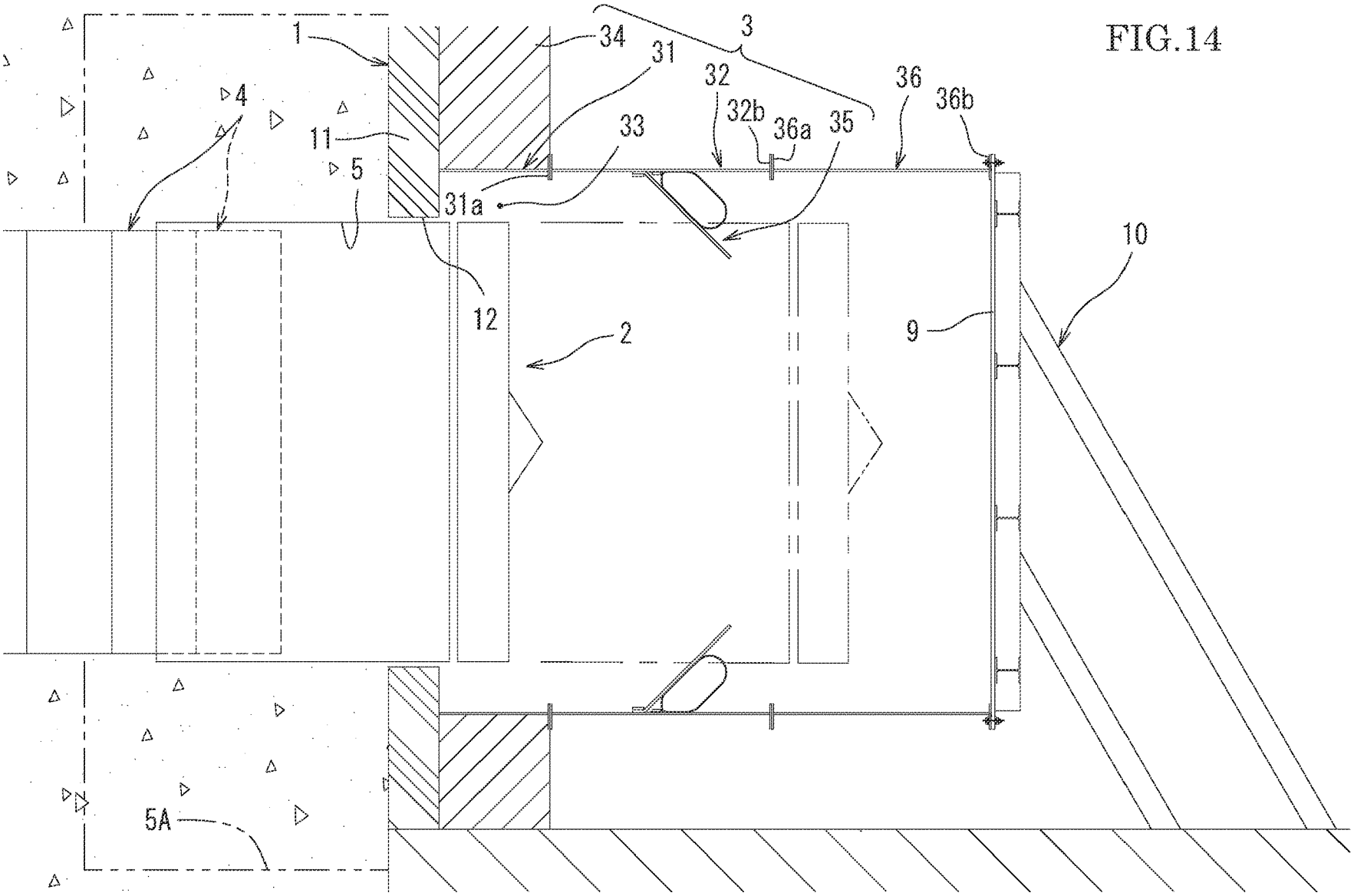
FIG. 14 is a cross-sectional view following FIG. 11, which illustrates a state in which a temporary lid is provided on the second cylindrical frame.

The diameter (winding diameter) of the wire 35*d* can be changed. For example, when the shield machine 2 is located rearward the sealing member 35 as shown in FIGS. 5, 11 and 14, the wire 35*d* is loosened by a drive unit (not shown) to allow the diameter to be expanded. In contrast, when the outer circumferential surface of the shield machine 2 comes into contact with the sealing member 35 as shown in FIGS. 6 and 12, the wire 35*d* is tightened by the drive unit (not shown) to allow the diameter to be reduced.

More specifically, in the state shown in FIGS. 5, 11 and 14, the wire 35*d* is loosened by the drive unit (not shown) to allow the diameter to be expanded. Therefore, when the shield machine 2 moves forward from this state, as shown in FIGS. 6 and 12, to enter the inner diameter side of the elastic sheet 35*a*, the elastic sheet 35*a* can be bent obliquely.

On the other hand, after the shield machine 2 is located at the position as shown in FIGS. 6 and 12, the wire 35*d* is tightened by the drive unit (not shown) to allow the diameter to be reduced. Therefore, the inner circumferential part of the elastic sheet 35*a* can be pressed against the outer circumferential surface of the shield machine 2.

(4) In the first to third shield methods, as the shield machine 2 excavates the horizontal hole 5, the back-filling material (not shown) is injected into the gap between the horizontal hole 5 and the segments 4. However, the present invention is not limited thereto. For example, it is possible not to inject the back-filling material, although this case is not shown in the drawings.

(5) As to the shield machine 2 used in the first to third shield methods, any other type of shield machine may be used, although it is not shown in the drawings.

(6) In the first to third shield methods, it is possible to inject a self-hardening agent such as mortar (not shown) into an annular space formed and surrounded by the shield machine 2, the first cylindrical frame 31, the second cylindrical frame 32 and the elastic sheet 35*a* after the elastic sheet 35*a* of the sealing member 35 is pressed against the outer circumferential surface of the shield machine 2 as shown in FIGS. 6 and 12.

It is possible to provide supply equipment of the hardening agent inside the entrance concrete 34 or inside the shield machine 2.

With the above-described configuration, it is possible to improve water-stopping effect by the sealing member 35 over the processes till the shield machine 2 is taken out from the second cylindrical frame 32. This configuration is also advantageous in maintenance of the water-stopping effect for a long time.

The present invention is suitably applied to a shield method in which a tunnel is made using a shield machine between two shafts constructed in the ground.

DESCRIPTION OF REFERENCE NUMERALS

1 Arrival shaft
11 Earth retaining wall
12 Entrance
2 Shield machine
21 Outer shell cylinder
22 Partition wall
23 Cutter head
24 Chamber
25 Screw conveyor
26 Erector
27 Chemical feeding port
28 Motor
3 Entrance apparatus
31 First cylindrical frame
31*a* Annular plate
32 Second cylindrical frame

32*a* First end side annular plate
32*b* Second end side annular plate
33 Entrance space
34 Entrance concrete
35 Sealing member
35*a* Elastic sheet
35*b* Elastic tube
36 Extended cylindrical frame
36*a* First end side annular plate
36*b* Second end side annular plate
37 Keep plate
38 Keep plate
39 Filler
4 Segment
5 Horizontal hole
5A Soil improvement area
6 Excavated soil and pieces
7 Temporary lid

What is claimed is:

1. A shield method in which a tunnel is made using a shield machine between two shafts constructed in the ground, the method comprising the following steps performed in this order:

a first step of providing a first cylindrical frame at a position where an entrance is to be formed in an inner surface of an earth retaining wall of a shaft on an arrival side of the shield machine, the first cylindrical frame into which the shield machine goes without coming into contact with any part thereof;

a second step of excavating a horizontal hole in the underground by the shield machine, sequentially adding and building, in an excavation direction, a plurality of segments that serves as an outer shell of the tunnel on an inner diameter side of the horizontal hole, and stopping, after forming the entrance in the arrival shaft, the shield machine such that the shield machine stays in the entrance;

a third step of temporarily stopping water from a gap between an inner circumference of the entrance and an outer circumferential surface of the shield machine, and after that removing excavated soil and pieces that enter the first cylindrical frame as a result of forming the entrance;

a fourth step of coupling a second cylindrical frame to an inner open end of the first cylindrical frame, the second cylindrical frame having at least a same inner diameter as an inner diameter of the first cylindrical frame, and furthermore having a sealing member that is attached to an inner diameter side of the second cylindrical frame;

a fifth step of pressing the sealing member against the outer circumferential surface of the shield machine when the shield machine goes beyond the sealing member after performing the fourth step;

a sixth step of further tightly pressing the sealing member against an outer circumferential surface of the segments when the shield machine moves further forward and reaches a location where the outer circumferential surface of the segments comes into contact with the sealing member;

a first auxiliary step of providing a temporary lid on the inner open end of the first cylindrical frame such that the inner open end is closed, and filling a space surrounded by the temporary lid, the first cylindrical frame and the earth retaining wall with a filler, the first auxiliary step being performed before advancing to the second step after performing the first step;

a second auxiliary step of removing the temporary lid, the second auxiliary step being performed before advancing to the third step after performing the second step;

a third auxiliary step of providing a temporary lid on an inner open end of the second cylindrical frame such that the inner open end is closed, the third auxiliary step being performed before advancing to the fifth step after performing the fourth step; and a fourth auxiliary step of removing the temporary lid that is provided in the third auxiliary step, the fourth auxiliary step being performed after performing the fifth step.

2. The shield method according to claim 1, wherein the sealing member includes: a tapered-shaped elastic sheet that is fixed to an inner circumferential surface of the second cylindrical frame, the elastic sheet having an inner diameter smaller than an outer diameter of the shield machine and an outer diameter of the segments; and a pressurizing member that bends the elastic sheet to reduce a diameter of the elastic sheet so that an inner circumferential part of the elastic sheet is pressed against the outer circumferential surface of the shield machine and the outer circumferential surface of the segments.

3. The shield method according to claim 2, wherein the pressurizing member includes: an elastic tube that expands as an inside thereof is filled with fluid; and a filling device that reduces the diameter of the elastic sheet by filling the elastic tube with the fluid.

4. The shield method according to claim 1, wherein the sealing member includes: an annular-shaped elastic sheet fixed to the inner open end of the second cylindrical frame so as to extend inside in a radial direction, the elastic sheet having an inner diameter smaller than an outer diameter of the shield machine and an outer diameter of the segments; and a wire mounted on a farther and outer side of the elastic sheet relative to the entrance, the wire being loosened to allow a diameter thereof to be expanded so that the elastic sheet is bent when the shield machine enters an inner diameter side of the elastic sheet, while being tightened to allow the diameter to be reduced so that an inner circumferential part of the elastic sheet is pressed against the outer circumferential surface of the shield machine.

* * * * *